United States Patent [19]

Foresman

[11] 4,107,035

[45] Aug. 15, 1978

[54] THREE-PLANE BALANCE GYRO SIFTER

[75] Inventor: James Daniel Foresman, Hughesville, Pa.

[73] Assignee: The Young Industries, Inc., Muncy, Pa.

[21] Appl. No.: 793,196

[22] Filed: May 2, 1977

[51] Int. Cl.[2] ..... B07B 1/44

[52] U.S. Cl. ..... 209/309; 209/315; 209/332

[58] Field of Search ..... 209/315, 319, 366, 366.5, 209/332, 363, 364, 309, 325, 326, 365, 367; 74/86, 87, 61; 259/72, DIG. 42; 366/111, 114, 115

[56] References Cited

U.S. PATENT DOCUMENTS

| | | | |
|---|---|---|---|
| 497,343 | 5/1893 | Rasch | 209/332 |
| 1,668,984 | 5/1928 | Simpson | 209/366 X |
| 1,791,291 | 2/1931 | Simpson | 209/332 |
| 2,114,406 | 4/1938 | Simpson | 209/319 X |
| 2,305,344 | 12/1942 | Gary | 209/366 |
| 2,676,706 | 4/1954 | Temple | 209/332 X |
| 3,003,635 | 10/1961 | Wood | 209/415 |
| 3,101,315 | 8/1963 | Denovan | 209/332 |
| 3,314,539 | 4/1967 | Mitchman | 209/332 X |
| 3,367,498 | 2/1968 | Tonjies | 209/319 |
| 3,498,456 | 3/1970 | Childs | 209/332 X |

*Primary Examiner*—Robert Halper

*Attorney, Agent, or Firm*—Mason, Fenwick & Lawrence

[57] ABSTRACT

A sifting and screening mechanism dynamically balanced in all three planes including a base, a screen assembly with an inclined screened frame having a screening surface with an inlet end and an outlet end, a linear bearing, a resilient mount assembly supporting the outlet end of the screened frame on the linear bearing to permit a generally reciprocating motion of the outlet end of the screen frame, a rotating eccentric drive attached to the screen assembly beneath the center of gravity of the assembly to impart a circular motion in a generally horizontal plane to the screen assembly at the center of gravity which, in combination with the linear motion of the outlet end of the screen, creates generally elliptical motion of the screen, a balancing shaft rotatably mounted on the base and spaced apart from the eccentric drive, a belt drive between the eccentric drive and the balancing shaft for maintaining the rate of rotation of the balancing shaft at the same speed as the eccentric drive, and two balance weights rigidly attached in exposed relation to the balancing shaft, apart and separated by a specific vertical distance to provide counterbalancing of all of the forces and reactions created by the screen assembly motion thereby providing a sifting mechanism of any screen slope which is completely balanced and produces increased screen motion at the inlet end to present more screen openings to particles traversing the length of the screen.

17 Claims, 43 Drawing Figures

50
60
204
184
202
200
192
194
169
170
196
190
184
7
99
58
169
72
68
58
64
72
52
66
7
64
66

170
174
172
180
180
176
178
180
168
162
166
158
160
166
146
144
154
150
152
148
144
58
128
138
137
136
134
132
137
130
134
72
142
140
142
140
126

Fig-6
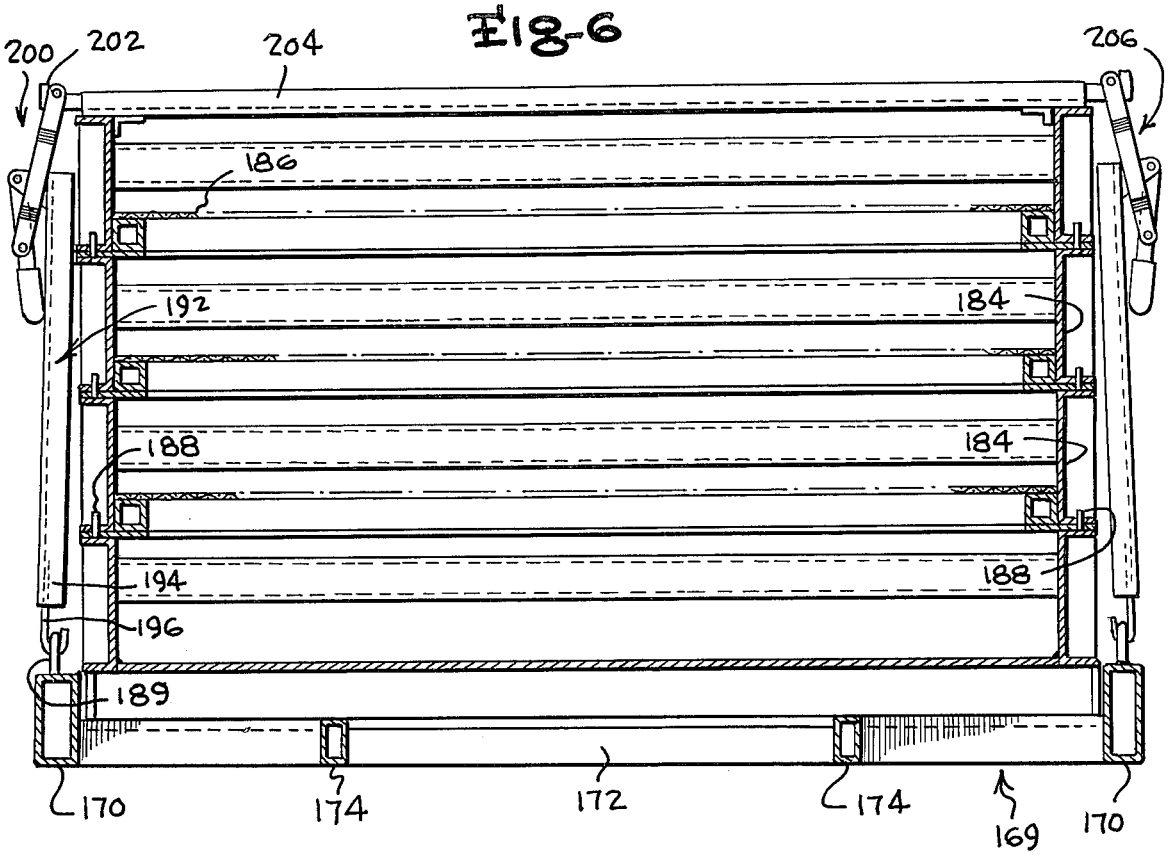
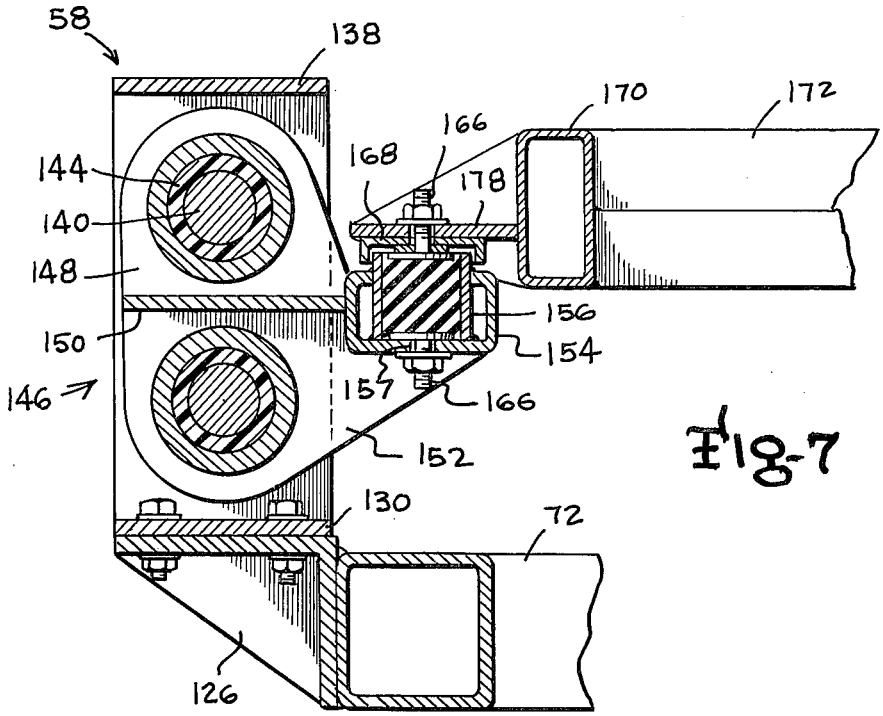
Fig-7

Fig-8
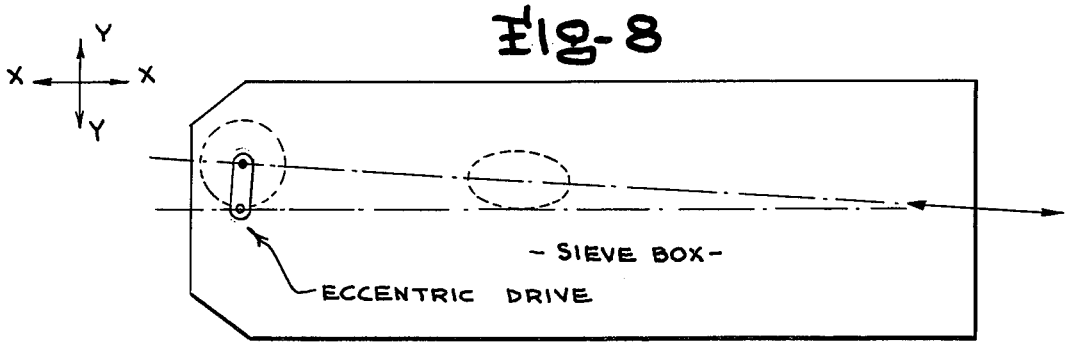
Fig-9a
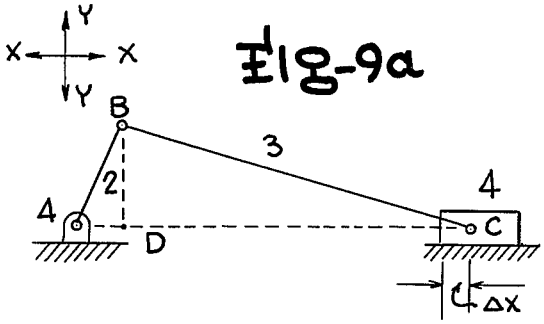
Fig-9b
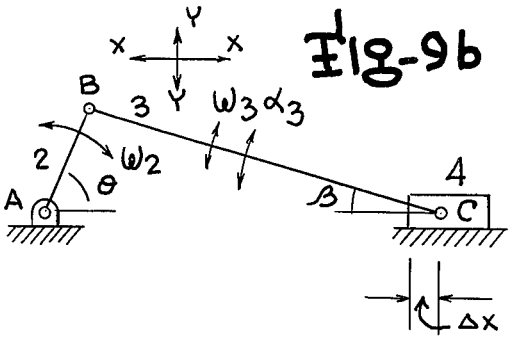
Fig-9c
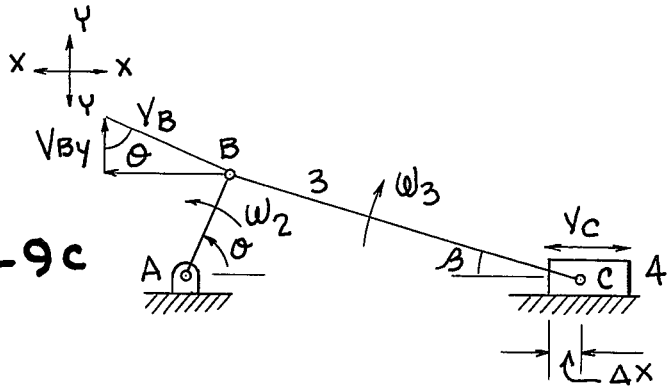
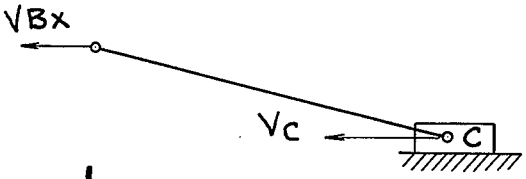
Fig-10a
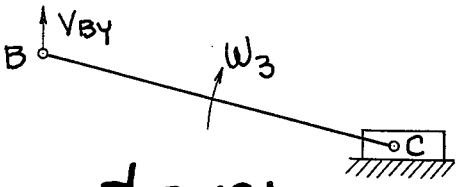
Fig-10b
Fig-11
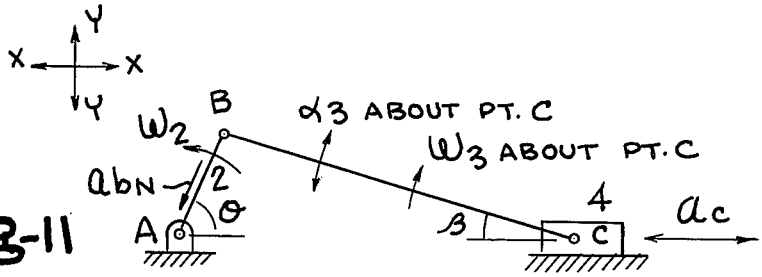

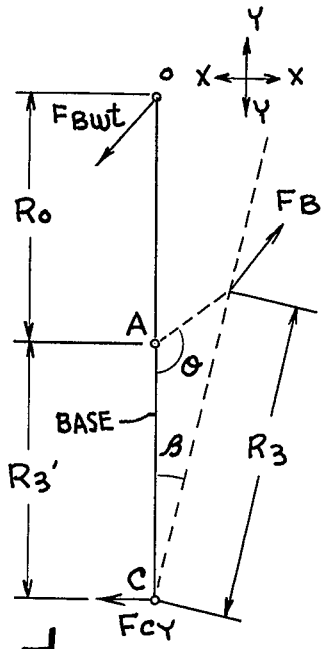
Fig-17c
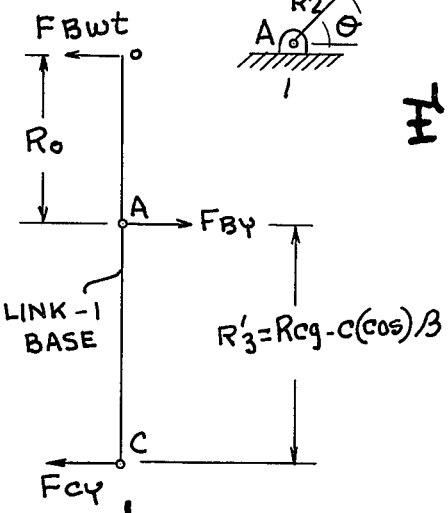
Fig-18
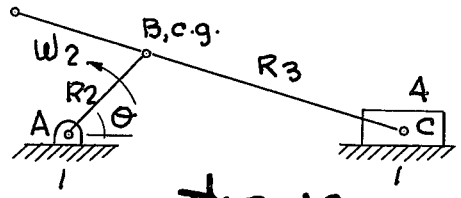
Fig-19
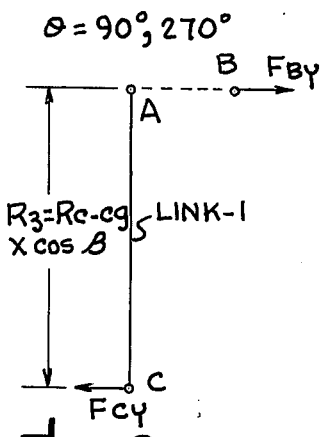
Fig-20a
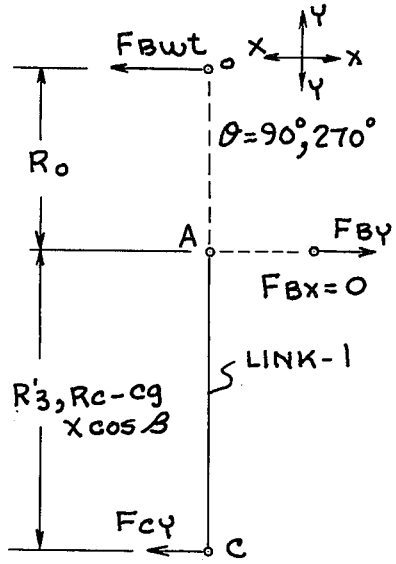
Fig-20b
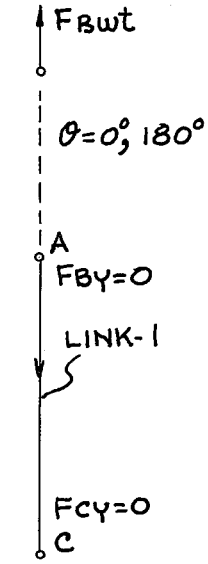
Fig-20c
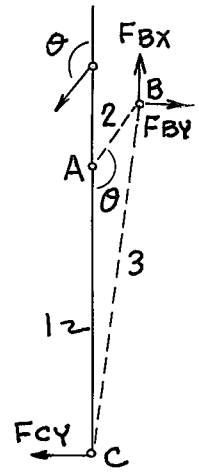
Fig-21
Fig-22
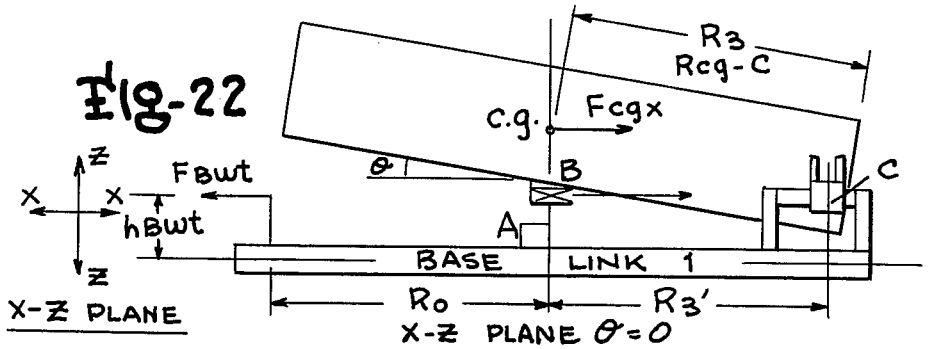

| θ | X | Y |
|---|---|---|
| 0 | 1 | 0 |
| 30 | .866 | 1.07 |
| 60 | .5 | 1.87 |
| 90 | 0 | 2.182 |
| 120 | -.5 | 1.89 |
| 150 | -.866 | 1.09 |
| 180 | -1 | 0 |
| 210 | -.866 | -1.09 |
| 240 | -.5 | -1.89 |
| 270 | 0 | -2.182 |
| 300 | .5 | -1.89 |
| 330 | .866 | -1.09 |
| 360 | 1 | 0 |

THREE-PLANE BALANCE GYRO SIFTER

This invention relates to screening and sifting mechanisms. More specifically, the invention relates to a screening and sifting mechanism which is capable of balancing all of the forces and reactions created by the motion of the screen assembly for any screen slope while producing increased screening motion relative to conventional sifting mechanisms.

Previously known gyratory-reciprocating type screeners have included box type assemblies which house various screens to sift the materials fed onto the screen at the inlet end. These previously known assemblies have been supported at the outlet end by linear bearings. The opposite end or inlet end is usually supported on an eccentric drive crank which transmits a circular motion to the inlet end. In these gyratory-reciprocating type screeners, the circular motion at the inlet end results in elliptical motion of the central portion and basically linear motion at the outlet end. The screens are generally positioned at an angle to the horizontal with the outlet end being lower than the inlet end to implement the screening or sifting action by enabling the material being processed to transfer the length of the screens from the inlet to the outlet.

The reaction forces generated by the circular motion imparted to the inlet end, combined with the linear motion at the outlet end, result in reaction forces which vary sinusoidally in magnitude and direction. Previous attempts to balance these reaction forces have generally resulted in the incorporated of counter-rotating balancing weights which are spaced apart one above the other at the inlet end of the mechanism. The counter-rotating weights are generally located in a housing attached to the base of the machine with the weights and the eccentric drive member all rotating about the same axis. The forces of the balance weights add vectorially and result in a continuously varying force which changes in both magnitude and direction. In these conventional mechanisms, the resultant forces associated with the balance weights is selected to be equal in magnitude to the reaction produced on the eccentric drive member by the screen assembly and opposite in direction to this reaction.

The main disadvantage of previously known gyratory-reciprocating type screeners has been that they were simply unable to balance all of the reactions and moments produced by the moving mass of the screener. Previous attempts to balance the reaction forces at the eccentric drive mechanism have been directed to a single plane while totally neglecting the reaction forces caused by the bearings at the outlet end of the screen which are a constraint and therefore create a reaction force. Conventional balancing methods have totally neglected the moments created by the screen movement and the reactions associated with the pitching of the screen surfaces at an angle to the horizontal. In the previously known mechanisms, the balance weights have not been positioned in the same plane or in the same plane with the eccentric drive, thereby creating additional unbalancing moments. Previously known methods for balancing gyratory-reciprocating type screeners have simply not provided a means for dynamically balancing the screeners in all three planes.

Therefore, it is the object of the present invention to provide a new and improved sifting and screening mechanism.

Another object of the present invention is to provide a sifting and screening mechanism which is dynamically balanced in all three planes.

A further object of the present invention is to provide a sifting and screening mechanism having a drive mechanism and balance weight mechanism which counteract all of the moments and reactions produced in all three planes by the moving mass of the mechanism.

A still further object of the present invention is to provide a dynamically balanced screening and sifter mechanism which does not require counter-rotating weights, thereby greatly reducing the cost and complexity of the drive and balance mechanism.

Another object of the present invention is to provide a sifting and screening mechanism which results in much greater screen surface motion without increasing the power requirements for operating the mechanism.

A still further object of the present invention is to provide a screening and sifter mechanism which will operate without producing excessive vibration or cause discomfort to the operators of the mechanism.

Another object of the present invention is to provide a simple sifting and screening mechanism which reduces the cost of construction and the cost of maintenance.

A further object of the present invention is to provide a sifter and screening mechanism which does not require an excessively heavy base and allows the screener to be positioned above the floor to permit easy cleaning while meeting the requirements of sanitary standards for food processing equipment.

A further object of the present invention is to provide a sifting and screening mechanism in which the screen may be operated at any angle relative to the horizontal while maintaining dynamic balancing in all three planes.

A better understanding of the manner in which the preferred embodiment of the invention achieves the objects of the invention will be enabled when the following written description is read in conjunction with the appended drawings in which:

FIG. 6 is a cross-sectional view taken along line 6—6 in FIG. 4;

FIG. 7 is a cross-sectional view taken along line 7—7 in FIG. 1; and FIGS. 8 through 31 show various schematic diagrams related to the force and motion analysis of the preferred embodiment.

Figure 1:
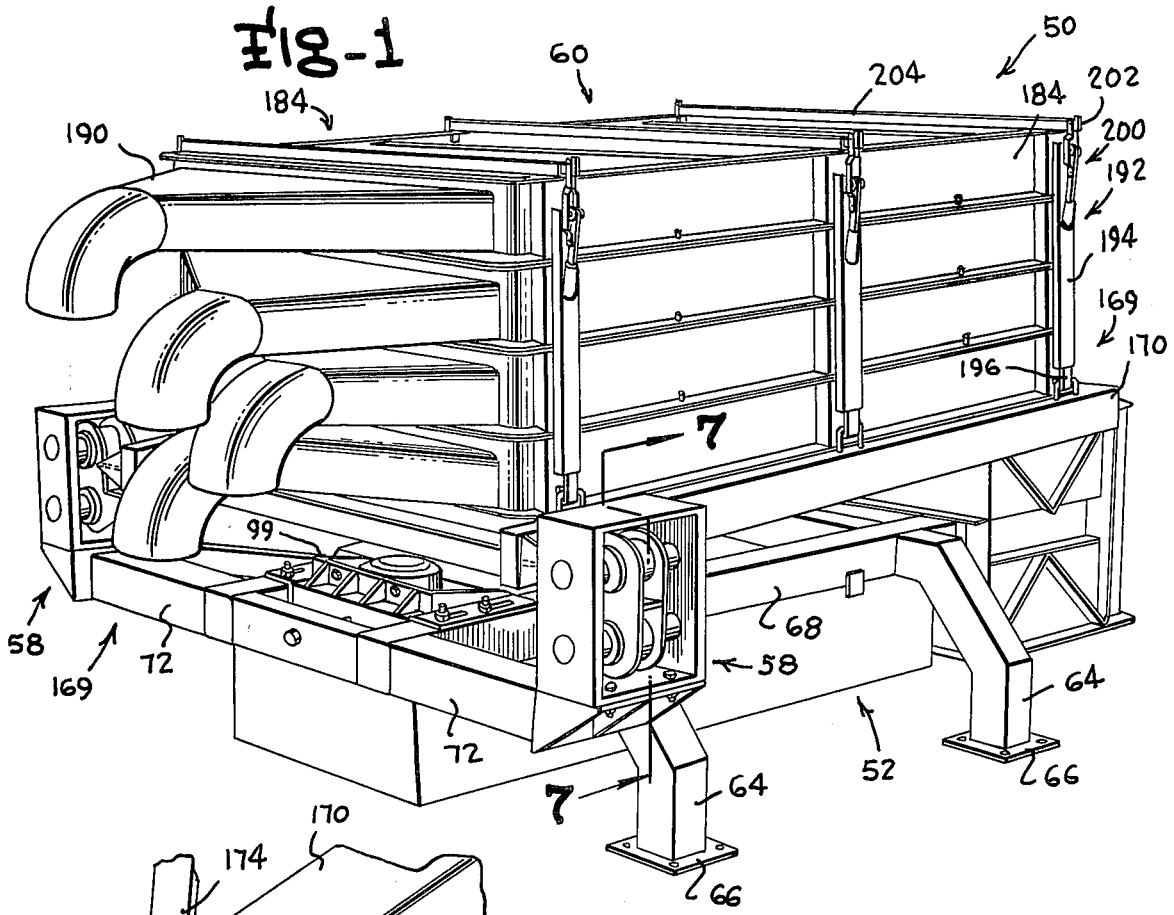
FIG. 1 is a perspective view of the preferred embodiment.

Attention is initially invited to FIGS. 1 through 7 of the drawings illustrating the preferred embodiment of the invention, generally indicated with reference numeral 50, which includes a base 52, an eccentric drive mechanism 54 mounted on the base, a balance shaft mechanism 56 mounted on the base, linear bearing and resilient mount assemblies 58 mounted on the base, and a sifting and screener assembly 60 mounted on the linear bearing and resilient mount assemblies 58 and the eccentric drive mechanism 54.

Figure 4:
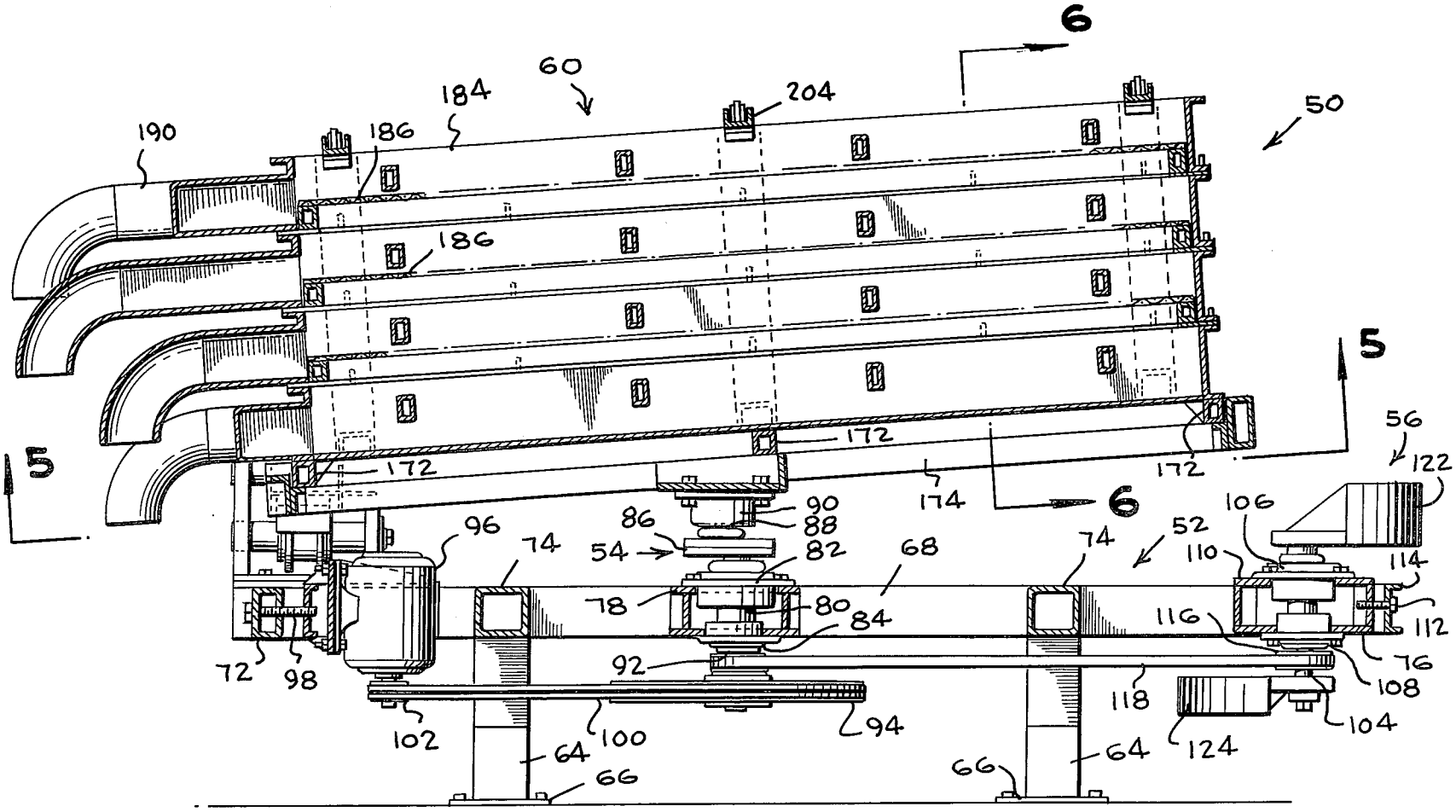
FIG. 4 is a cross-sectional view taken along line 4—4 in FIG. 3.

The base 52, formed of square steel tubing which is easily welded to achieve the desired configuration, includes identical forward and rear knee member 64 having base plates 66 at the lower end thereof with through-holes to permit bolting the plates to the floor as indicated in FIG. 4. The upper ends of the knees 64 are attached to side rails 68 of a main frame. The main frame additionally includes a transverse front rail 72 which extends between and is cantilevered outboard the two longitudinal side rails 68 to provide support for the bearing and mount assemblies 58 as best shown in FIG. 1. Transverse reinforcing tubes 74, as shown in FIG. 4, are welded to the inside surface of the longitudinal side rails 68 adjacent the upper ends of the knees 64 to reinforce the side rails and reduce the resilience of the base 60. A transverse rear rail 76 provides support for the balance shaft mechanism 56 as best shown in FIG. 4. An eccentric drive mechanism support member 78, as shown in FIG. 4 extends transversely between the side rails 68 parallel to the transverse reinforcing tube 74 to provide a support structure for the eccentric drive mechanism 54.

Figure 3:
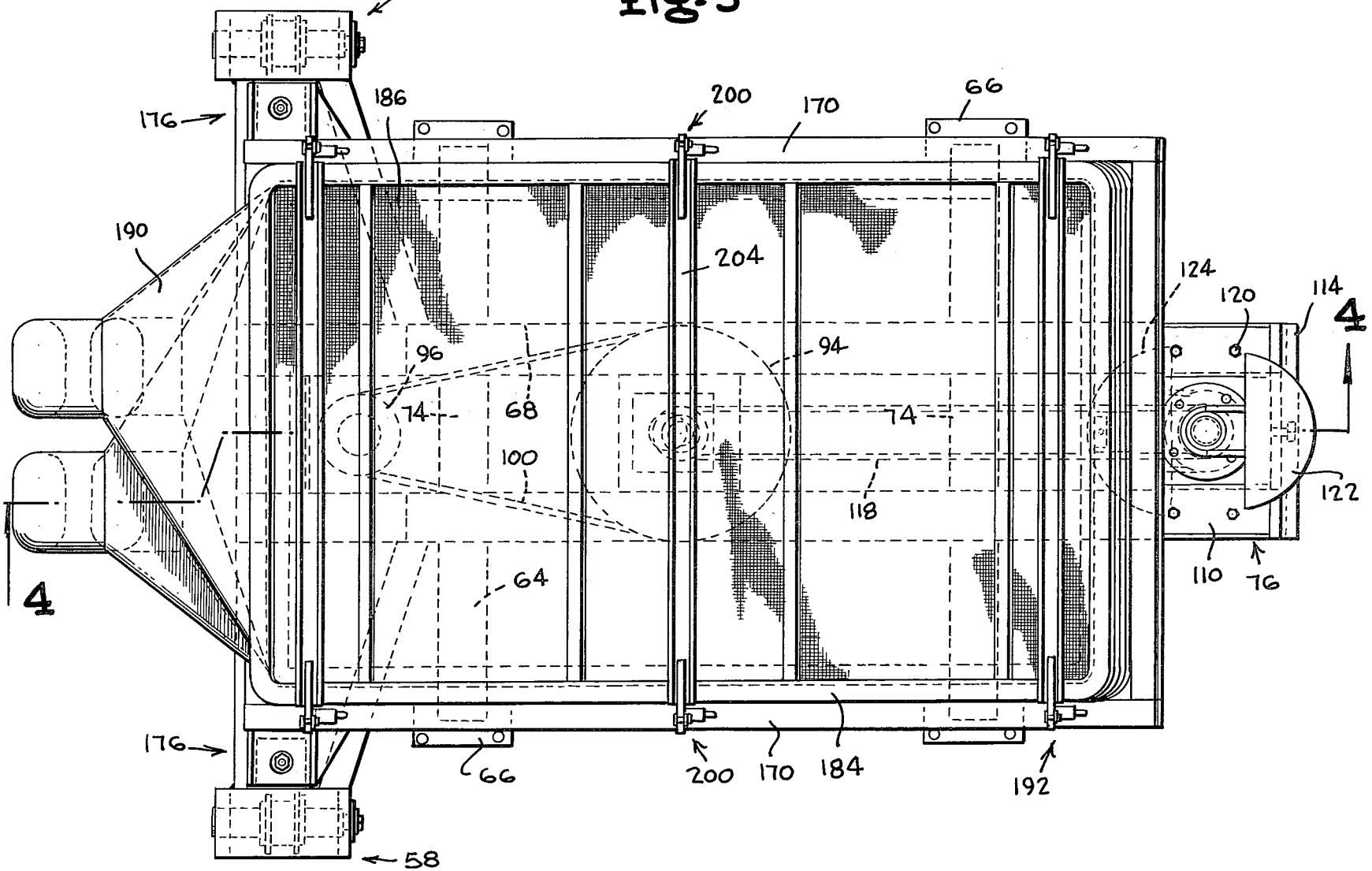
FIG.3 is a top plan view of the preferred embodiment shown in FIG. 1.

Referring particularly to FIGS. 3 and 4, it can be seen that the eccentric drive mechanism 54 includes a drive shaft 80 journaled in an upper bearing assembly 82 and a lower bearing assembly 84 with both of the bearings mounted on the support member 78. Attached to the upper end of the drive shaft 78 is an eccentric plate 86 having an eccentric shaft 88 parallel to the drive shaft 80 and spaced apart therefrom which rotatably engages an eccentric drive bearing 90 positioned under the center of gravity of the sifter and screening assembly to produce circular movement of the sifting and screener assembly along the axis of the eccentric shaft 88. Attached to the lower end of the drive shaft 80 outboard the lower bearing assembly 84 is a balance shaft drive pulley 92 and a duel driven pulley 94. An electric motor 96 is mounted on the transverse front rail 72 by a tension adjusting bolt 98 and a support plate 99 which may be slid and locked on the side rails 68 as indicated in FIG. 1. This configuration permits adjusting the tension of drive belts 100 which engage a duel drive pulley 102 mounted on the drive shaft of the motor 96 to provide driving power to the driven pulley of the eccentric drive mechanism 54. Appropriate electrical controls are provided for the electric motor 96.

The balance shaft mechanism 56, as best shown in FIGS. 3 and 4, includes a drive shaft 104 journaled in an upper bearing assembly 106 and a lower bearing assembly 108 which are bolted to the transverse rear rail 76. The transverse rear rail 76 is not attached to the side rails 68 but instead has an upper plate member 110 which overlaps the side rails as shown in FIG. 3 to provide sliding support for the balance shaft mechanism. A tension adjusting bolt 112 extends through a tension bolt channel 114 fixed at its ends to side rails 68. A balance shaft driven pulley 116 is mounted on a lower outboard end of the balance shaft 104 to receive the balance shaft drive belt 118 which operatively engages the balance shaft driven pulley 116 and the balance shaft drive pulley 92 to maintain synchronization between the balance shaft 104 and drive shaft 80. Lock down bolts 120 permit fixing the plate 110 in the desired position after the tension adjusting bolt 112 has been rotated to the desired position. An upper eccentric balance weight 122 is mounted on the upper end of the balance shaft 104 and a lower balance weight 124 is fixed to the lower end of the balance shaft outboard the lower bearing assembly driven pulley 116 at a position 180° or directly opposed to the upper balance weight 122. The positioning and size of the balancing weights will be described in the theory discussed hereafter. The drive belt 118 and pulleys 92 and 116 are of conventional configuration including teeth or the like to ensure that the angular relationship between the balance weights and the eccentric shaft 88 does not change during the operation of the mechanism thereby producing the same rate of rotation.

Figure 2:
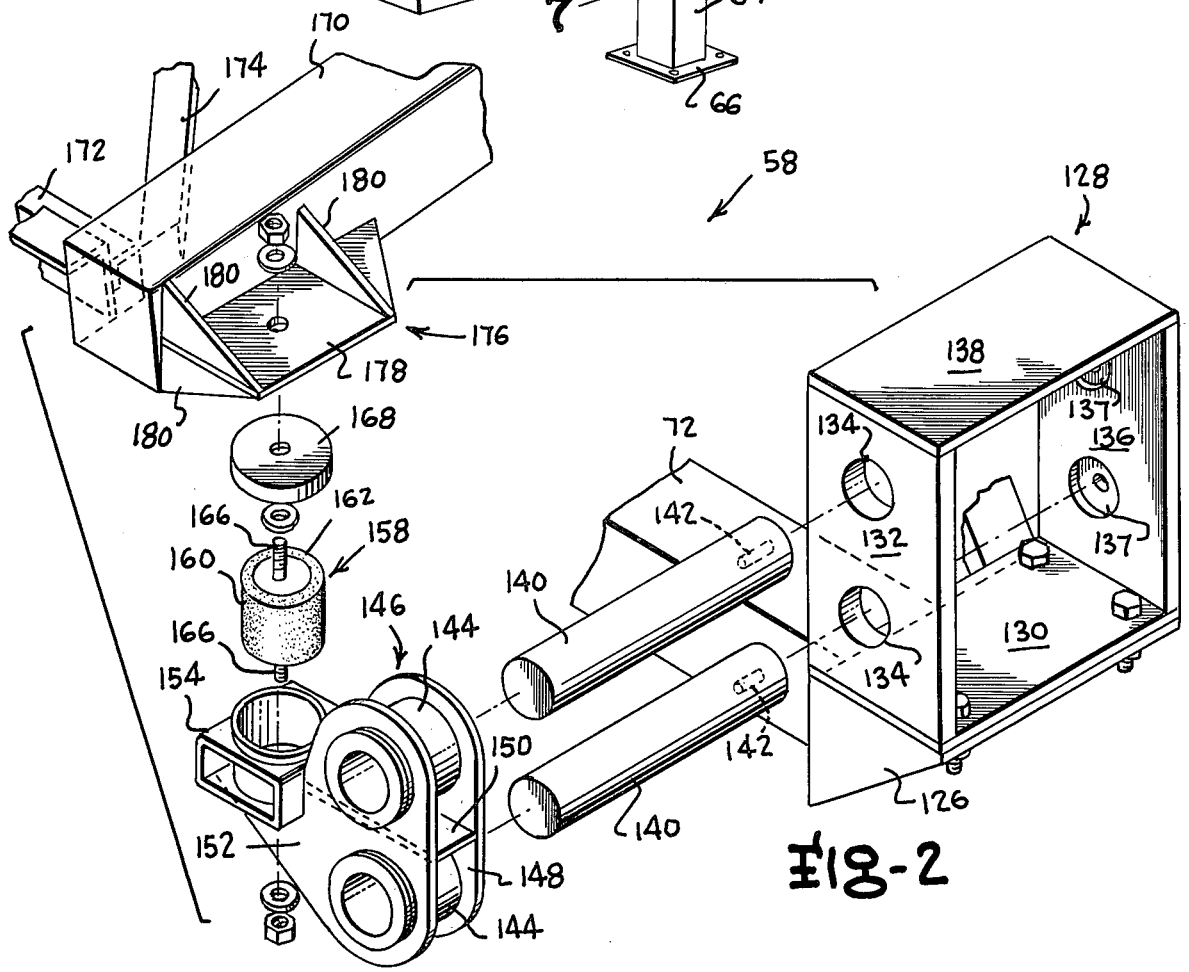
FIG. 2 is an enlarged exploded fragmentary view of the linear bearing and resilient mount assembly of the preferred embodiment.

Referring now to FIG. 2, it will be noted that the linear bearing and resilient mount assembly 58 includes a support bracket 126 fixed to the end of the transverse front rail 72. A support frame 128 having a lower plate bolted to the support bracket 126, an upright front plate 132 welded to the forward edge of the lower plate 130 and having two spaced apart bores 134, and a back plate 136 welded to the rear edge of the lower plate and having two spaced apart bores 137 extending partially therethrough in alignment with and of the same diameter as the bores 134 in the front plate 132. A smaller diameter bore extends from the bottom of bores 137 and through the back plate 136. A top plate 138 is welded to the top edges of the front and rear plates.

A pair of linear bearing rods 140 of slightly smaller diameter than bores 134 are inserted through the bores and into the rear bores 137 where they may be retained in position by bolts extending through the small diameter rear bores 137' and into threaded bores 142 in the bearing rods. Slidingly engagable with the bearing rods 140 are a pair of bushings 144 mounted in a carrier 146 formed of two side plates 148 having bores therethrough to receive the bushings 144 and reinforced by a separator plate 150 fixed to the inside surfaces of the side plates 148. The bushings are spaced apart and have their axes parallel to slidingly engage the bearing rods 140 when positioned in the support frame 128 as indicated in FIG. 7.

The side plates 48 have rear extensions 152 which provide support for a short rectangular tube 154 mounted thereon in alignment with the axes of the bushings 144 and having an opening through the upper wall thereof to receive a short tubular segment 156 which is inserted through the opening and welded to the lower wall of the tube. A bore 157 extends through the bottom wall of the rectangular tube 154 and is concentric with the tubular segment 156. A resilient mount 158 as shown in FIG. 2 includes a resilient cylindrical body 160 formed of neoprene or the like and has an upper disc 162 and a lower disc 164 bonded to opposite ends of the cylindrical body with studs 166 extending outwardly from the centers of the discs. THe lower disc 166 extending through the bore 157 in the lower wall of the rectangular tube 154 to receive a nut thereon which retains the resilient mount 158 within the tubular segment 156 as shown in FIG. 7. A protective disc 168, as shown in FIG. 7, has a downwardly directed outer lip which extends around the tubular segment 156 and is spaced above and outside the upper lip of the segment to permit limited movement of the sifting and screener assembly 60 relative to the linear bearings. This assembly configuration provides torsional freedom and a slight lateral movement to compensate for bearing misalignment and the slight misalignment which would result from the circular motion of the center of gravity of the sifting and screener assembly during operation of the mechanism thereby preventing over-stressed and premature failure of the assembly.

Figure 5:
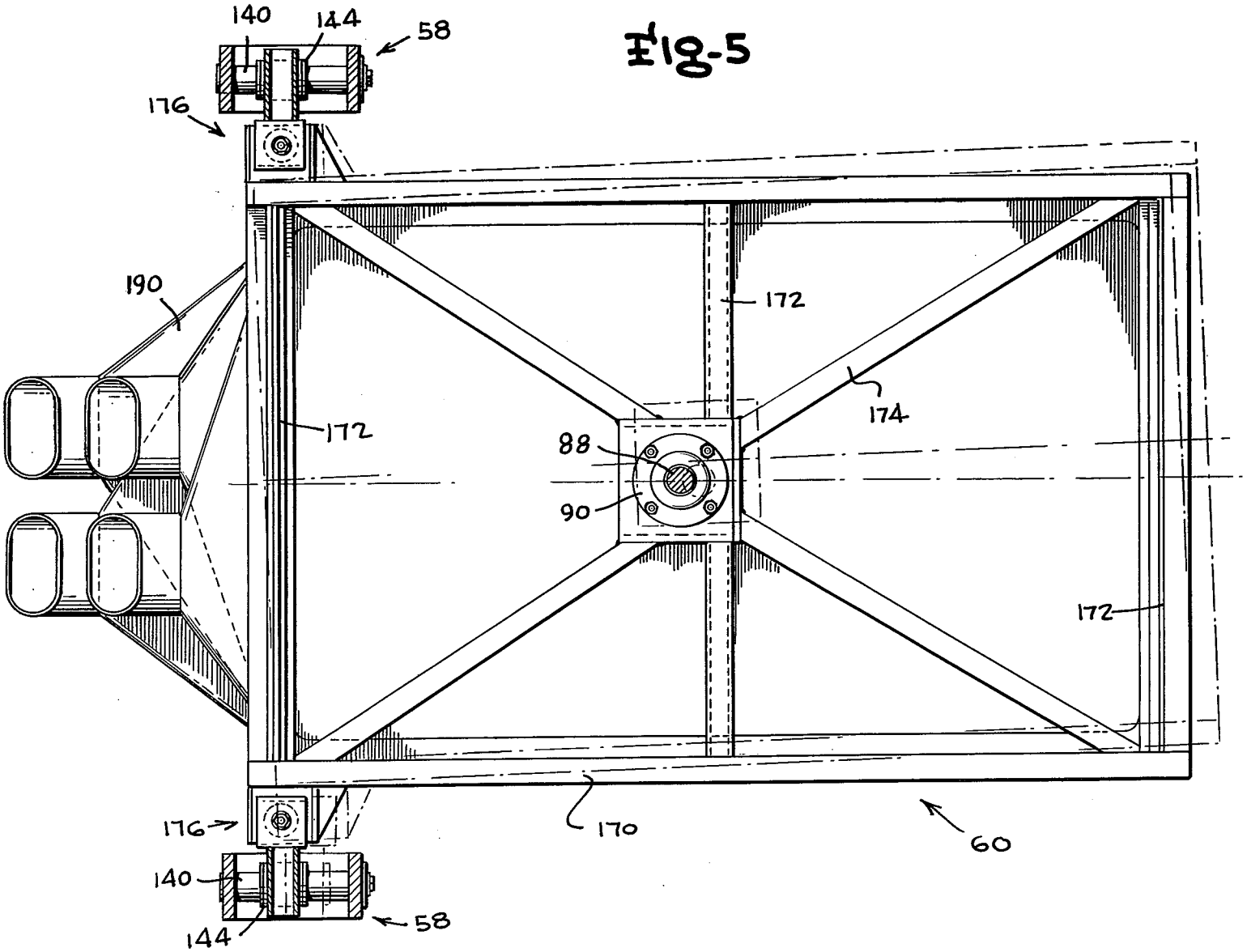
FIG. 5 is a cross-sectional view taken along line 5—5 in FIG. 4.

Referring to the various drawings, the screener assembly 60 generally includes a support frame 169 having side rails 170, transverse rails 172, and diagonal reinforcing rails 174 as shown in FIG. 5. Mounted on front ends and outer surfaces of the side rails 170 are mounting brackets 176, as shown in FIG. 2, which include a mounting plate 178 welded perpendicular to the side rail 170 and oriented in a horizontal plane as suggested in FIG. 2 with reinforcing gussets 180 extending between the mounting plate 178 and the side rail 170 to transfer the necessary loads to the bearing and mount assembly 58. An opening 182 in the center of the mounting plate 178 receives stud 166 which extends through the motion limiting disc 168 and receives a nut as shown in FIG. 7. The eccentric drive bearing 90 is mounted on a support member 183 fixed to the transverse rails 172 and to the diagonal rails 174 of the sifting and screener frame 169 as indicated in FIGS. 4 and 5.

Mounted on the sifting and screener frame 169 are sieve boxes 184 having screens 186 of the desired mesh extending over the bottom surfaces thereof to provide the desired sifting and screening. The sieve boxes 184 include alignment pins 188, as shown in FIG. 6, extending from an upper edge thereof which are engagable with holes in a lower edge of an adjacent sieve box to align the sieve boxes as shown in FIG. 6. The sieve boxes have an outlet end which includes an outlet funnel 190, as shown in FIGS. 1 and 4, to direct the material which does not pass through a given sieve box to the desired collecting device which is not shown. The inlet end of the sieve box is at the end opposite the outlet funnel 190 with material being guided into the inlet end in the conventional manner either in a batch or continuously. The sieve boxes are clamped in position by the toggle assemblies 192, as best shown in FIG. 1, which include a body 194 having a hook member 196 at the lower end thereof engagable with u-shaped bolt 198 attached to the side rail 170 as shown in FIGS. 1 and 6. A toggle action latch 200 at the upper end of the body 194 is engagable with a hook 202 of a lock-down bar 204 which extends across the uppermost sieve box with a plurality of toggle assemblies 192 on opposite sides of the sieve boxes to clamp all of the sieve boxes together to prevent any leakage of materials from between the boxes.

Appropriate covers may be provided for the various assemblies as shown in FIG. 1 to prevent accumulation of dust and dirt on the various components.

The motion of the sifter and screening assembly 60, which results from the rotation of the eccentric shaft 88 by the eccentric drive mechanism 54, is generally elliptical except in the vicinity of the axis of the eccentric shaft 88 where the motion is circular and in the vicinity of the outlet end where the linear bearings cause the motion to be translational. A more detailed discussion of this motion is to be included in a following section. It can be seen from the various positions assumed by the assembly, as indicated in dashed lines in FIG. 5, that the bushings 144 will reciprocate along the linear bearing rods 140 as the eccentric shaft 88 is rotated around a circular path. As the inlet end moves from side to side, misalignment of the bushings 144 is prevented by the resilient mounts 158 which flex to prevent any misalignment of the linear bearings. The downwardly projecting lip of the protective disc 168 will contact the upper portion of the tubular segment 156 to prevent any excessive movement between the sifter and screener assembly and the linear bearing carriers 146.

Following is the theory which described the motion and dynamics of a gyrating, reciprocating screener commonly called a gyratory screener. These screeners include a sieve box containing the screens which are driven and supported at one end by an eccentric drive. The box is supported at the other end by a mechanism which produces rectilinear motion. The eccentric drive imparts the motion to the sieve box which is circular at the eccentric drive and elongated ellipses in the center and rectilinear at the opposite end. A diagrammatic view of such a screener is shown in FIG. 8.

A mechanism with this type of motion is commonly referred to as a slider-crank mechanism and is diagrammatically shown in FIG. 9*a*.

Throughout the following discussion, the sifter mechanism according to the present invention will be referred to schematicaly as a slider-crank mechanism as shown in FIG. 9*b* where:

Link 1 simulates the base and drive mechanism
Link 2 simulates the eccentric
Link 3 simulates the sieve box, and
Link 4 simulates the sliding joint between sieve box and the base The following notation will be used throughout:

$R_2$ = eccentric length in inches, distance AB
$R_3$ = distance between sieve box supports, distance BC, not necessarily the total sieve box length
$\theta$ = angular displacement or rotation relative to the co-ordinate axis shown, of the eccentric ($R_2$)
$\beta$ = angular displacement of the sieve box and supported length $R_3$
$\omega_2$ = angular velocity of eccentric in radians/sec
$\omega_3$ = angular velocity of $R_3$ in radians/sec
$\alpha_3$ = angular acceleration of $R_3$ in radians/sec$^2$
$\Delta x$ = sieve box linear displacement in the X-direction
$M_3$ = sieve box mass (*wt/gc*)
*cg* = sieve box center of gravity
$R_{cg\text{-}C}$ = distance in inches from cg to point C
$R_{B\text{-}cg}$ = distance in inches from cg to point B
I = mass moment of inertia of sieve box about an axis perpendicular to the page through point *c* (Z-axis) in units of in-lb-sec$^2$ Any reaction at a point will be designated by the letter F and the subscript of that point (example: the bearing reaction at point B will be designated $F_B$, the X-component is $F_{BX}$, etc.)

Linear accelerations will be designated by the letter *a*; $a_{cgx}$, $a_B$, $a_{BY}$, etc.

Linear velocities will be designated by the letter V; $V_B$, $V_C$, etc. Units used throughout are inches, pounds, seconds, and radians. The following assumptions will be made.

1. $\omega_2$ or drive speed is known and constant.
2. Motion of point C is constrained to linear motion and displacement $\Delta X$ is known.
3. Links 2 and 3 ($R_2$ and $R_3$) are rigid.

DERIVATION OF DISPLACEMENT, VELOCITY, ACCELERATION AND FORCE (REACTION) EQUATIONS

Referring to FIG. 9*c* the following observations can be made, due to the constraints of the system.

$$\Delta x = R_2 \text{ cosine } \theta \qquad 1^*$$
$$\omega_2 = \text{RPM 1 min/(60 sec) } 2\pi \text{ Rd/Rev.} = \text{Rd/sec} = \text{constant}$$
$$V_B = R_2 \times \omega_2 = \text{in/sec } (V_B \text{ is always perpendicular to } R_2) \qquad 2^*$$

-continued $$V_{Bx} = V_B \text{ cosine } \theta,\ V_{By} = VB \sin\theta$$

therefore,

| when $\theta = 90°, 270°$ | when $\theta = 0°, 180°$ |
|---|---|
| point C is at mid-point of stroke, $\Delta x = 0$ | point C is at its maximum displacement, +−, $\Delta x$ = max. |
| $V_c$ (Linear velocity of point C) = maximum | $V_c = 0$ |
| $\omega_3 = 0$ | $\omega_3$ = Maximum |

also, note the following:

$$R_{BD} = R_2 \times \sin\theta$$

$$\sin\beta = \frac{R_{BD}}{R_3} = \frac{R_2 \sin\theta}{R_3};\ \beta = \text{Arc sin}\frac{(R_2 \sin\theta)}{R_3} \qquad 3^*$$

Known:

$\omega_2$ = RPM 2 $\pi/60$ = const., $V_B$ direction and magnitude $$\alpha_2 = 0\ \frac{(d\ (\text{const.})}{dt} = 0$$

direction of motion of point C is in the $x$ direction only.

Note that the motion of $R_3$ consists of linear translation and rotation about point C which describes general plane motion and is shown in FIGS. 10, *a* and *b*. There is relative motion between point B and point C while point B has a Y-component and point C has a zero Y-component. Relative motion between two points will be designated as: example, C/B $V_{C/B}$ = Velocity of point C relative to point B $a_{B/C}$ = acceleration of point B relative to point C Since $V_C = V_B + V_{C/B} = R_2\,\omega_2 + R_3\,\omega_3$ $V_{C/B} = R_3\,\omega_3$, then $V_C = V_B + V_{C/B}$ From the law of sines $$\frac{V_c}{\sin[180° - (90° - \theta) - (90° - \beta)]} = \frac{V_B}{\sin(90° - \beta)} = \frac{V_{c/b}}{\sin(90° - \theta)}$$

and rearranging terms $$\omega_3 = \frac{R_2\omega_2 \sin(90° - \theta)}{R_3 \sin(90° - \beta)} = \frac{R_2\omega_2 \text{ cosine } \theta}{R_3 \text{ cosine } \beta} \qquad 4^*$$

Now that $\omega_3$ can be calculated, the angular acceleration of $R_3$ can be determined in the following manner by referring to FIG. 11.

Accleration of link 2 ($R_2$)

$$\omega_2 = \text{constant},\ \therefore\ \alpha_2 = 0$$

the only acceleration affecting point B is the normal acceleration of the eccentric ($a_{bn} = R_2\omega_2^2$) and is shown in FIG. 11 and is always in the same direction as $R_2$ directed towards point A.

$$a_b = a_{bn} = R_2\,\omega_2^2$$

Figure 12A:
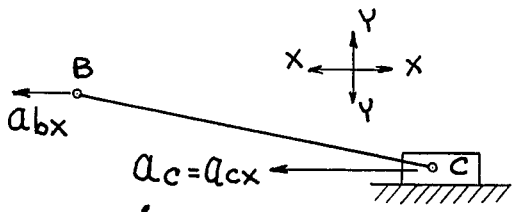
Figure 12B:
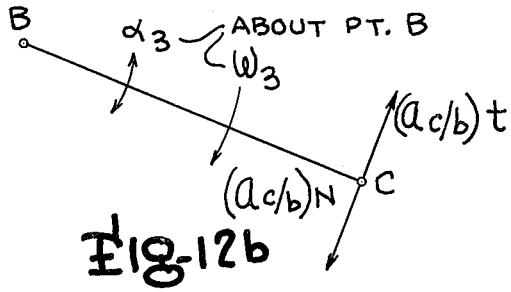

Acceleration of link 3 ($R_3$) as shown in FIGS. 12 *a* and *b*

$$a_c = a_b + a_{c/b} = a_b + (a_{c/b})_t + (a_{c/b})_n$$

$$a_c = R_2\,\omega_2^2 + R_3\,\alpha_3 + R_3\,\omega^3{}_2$$

where $$a_t = R\,\alpha$$

$$a_n = R\omega^2$$

Figure 13:
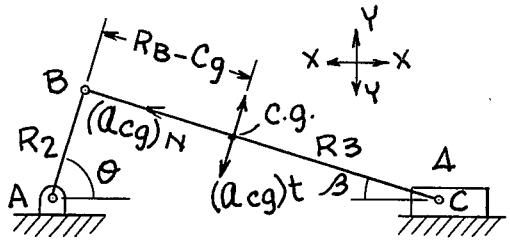

Equating Y Components:

$$0 = -R_2\omega_2^2 \text{ sine } \theta \pm R_3\alpha_3 \sin(90° - \beta) + R_3\omega_3^2 \sin\beta$$

$$\alpha_3 = \frac{R_2\omega_2^2 \sin\theta - R_3\omega_3^2 \sin\beta}{R_3 \sin(90° - \beta)} \qquad 5^*.$$

sign of $\alpha_3$ is dependent upon $R_2\omega_2^2 \sin\theta$ and $R_3\omega_3^2 \sin\beta$ Now the $R_2$, $R_3$, $\theta$, $\beta$, $\omega_2$, $\omega_3$, and $\alpha_3$ are known or can be calculated, at any point on $R_3$ the acceleration of that point can be determined for any degree of rotation $\theta$. Of particular interest is of course the center of gravity of $R_3$. Referring to FIG. 13:

$$a_{cg} = a_b + (a_{cg/b})_t + (a_{cg/b})_n$$

$$a_{cg} = a_b + R_{b-cg}\alpha_3 + R_{b-cg}\omega_3^2$$

$$a_{cgx} = (-R_2\omega_2^2 \text{ cosine } \theta) + (R_{b-cg}\alpha_3 \sin\beta - (R_{b-cg}\omega_3^2 \text{ cosine } \beta) \qquad 6^*.$$

$$a_{cgy} = (-R_2\omega_2^2 \sin\theta) + R_{b-cg}\alpha_3 \text{ cosine } \beta) + (R_{b-cg}\omega_3^2 \sin\beta) \qquad 7^*.$$

$a_{cg} = \sqrt{a_{cgx}^2 + a_{cgy}^2}$, vector direction relative to the $X - Y$ plane: $\gamma$ = Arc tan $a_{cgy}/a_{cgx}$ Note: c.g. acceleration equations are developed relative to point B, therefore the proper direction of $(a_{cg})_n$ must point towards point *b*.

Assuming all links are rigid the motion of the slider crank mechanism in the X–Y plane is completely described by equations 1 through 5. Of particular interest is the motion of link 3 since the dynamic mass in the present invention is concentrated about Link 3.

Assumptions:

All links are rigid

All pin joints are frictionless joints

The sliding joint is frictionless.

Knowns:

Lengths of Links 2 and 3 and eccentric or drive speed, $\omega_2$

Figure 14A:
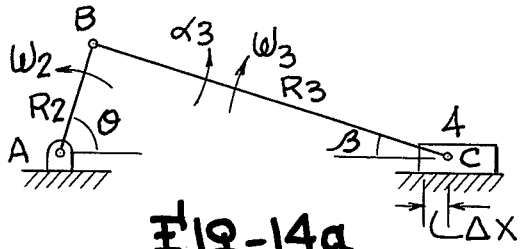

Referring to FIG. 14*d*, the following equations describe the motion of the mechanism:

$$\Delta X = R_2 \text{ cosine } \theta \qquad 1.$$

$$V_b = R_2\,\omega_2,\ V_{bx} = V_b \text{ cosine } \theta,\ V_{by} = V_b \sin\theta \qquad 2.$$

$$\beta = \text{Arc sin}\frac{(R_2 \sin\theta)}{R_3} \qquad 3.$$

$$\omega_3 = \frac{R_2\omega_2 \text{ cosine } \theta}{R_3 \text{ cosine } \beta} \qquad 4.$$

$$\alpha_3 = \frac{(R_2\omega_2^2 \sin\theta) - (R_3\omega_3^2 \sin\beta)}{R_3 \sin(90° - \beta)} \qquad 5.$$

$$a_{cgx} = (-R_2\omega_2^2 \cos\theta) + (R_{b-cg}\alpha_3 \sin\beta) - (R_{b-cg}\omega_3^2 \cos\beta) \qquad 6.$$

$$a_{cgy} = (-R_2\omega_2^2 \sin\theta) + (R_{b-cg}\alpha_3 \text{cosine } \beta) + (R_{b-cg}\omega_3^2 \sin\beta) \qquad 7.$$

Once the motion of the mechanism is determined, the dynamics can be calculated if the mass and the moment of inertia of the moving body are known.

In the following discussion it will be assumed that all moving mass is concentrated along Link 3 and that Link 2 and Link 4 have no mass.

Figure 14B:
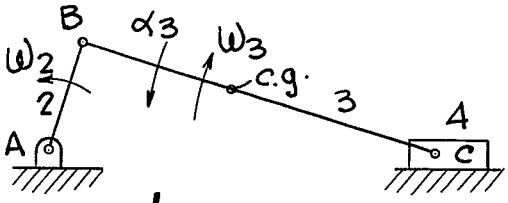
Figure 14C:
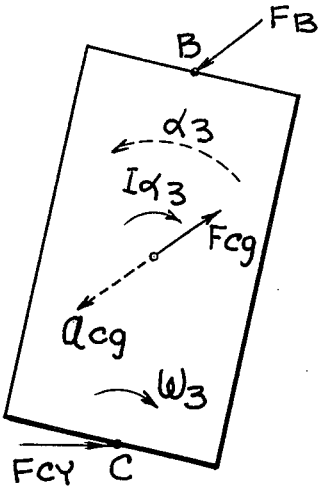

Referring to FIGS. 14 *b* and *c* it can be seen that:

$$F_{cg} = \sqrt{F_{cgx}^2 + F_{cgy}^2} \quad 8^*.$$

$$F_{cgx} = \frac{WT}{G_c}(-a_{cgx}) \quad 9^*.$$

$$F_{cgy} = \frac{WT}{G_c}(-a_{cgy}) \quad 10^*.$$

$$\text{Mass} = \frac{WT}{G_c}$$

Since joints B and C constrain the motion of $R_3$, reactions are produced at these points. It is assumed that in the X direction the linear bearing at point C is frictionless; therefore, there is no reaction in the X-direction at point C. Reactions $F_B$ and $F_C$ are dependent on the mass of $R_3$, the center of gravity, the moment of inertia of $R_3$ about a reference point, the linear accelerations in the X and Y directions of the center of gravity of $R_3$, and the angular acceleration of $R_3$. Values for all of these variables can be obtained. With this information, expressions for the reactions at points B and C for any degree of rotation $\theta$ can be determined.

Figure 15:
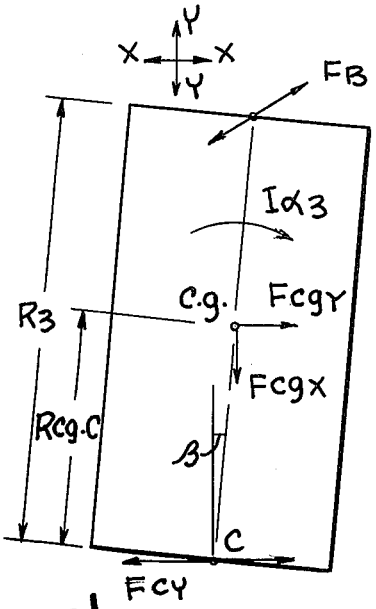

For $R_3$ to be in equilibrium and referring to FIG. 15:

Known:

$\omega_2$, $R_2$, $R_3$, $R_{cg-c}$, I about point C, $\omega_3$, $\alpha_3$, $F_{cgy}$, $F_{cgx}$.

Unknown:

$F_B$, $F_{cy}$

Note:

$I\alpha_3$ is in opposite direction to $\alpha_3$ $F_{cgx}$ is in the opposite direction to $a_{cgx}$ $F_{cgy}$ is in the opposite direction to $a_{cgy}$ Therefore:

$$\text{A. } \Sigma M_c = O = (F_{cgy}R_{cg-c}\cos\beta) + (F_{cgx}R_{cg-c}\sin\beta) + I(-\alpha_3) - (F_{BY}R_3\cos\beta) - (F_{BX}R_3\sin\beta)$$

$$\text{B. } \Sigma F_x = O = -F_{cgx} \pm F_{BX}$$

$$F_{BX} = F_{cgx} \quad 11^*$$

$$\text{C. } \Sigma F_y = O\, F_{cgy} \pm F_{BY} \pm F_{cy}$$

substituting for $F_{BX}$ in Eq. A and solving for $F_{BY}$ $$O = (F_{cgy}R_{cg-c}\cos\beta) + (F_{cgx}R_{cg-c}\sin\beta) + I(-\alpha_3) \pm (F_{BY}R_3\cos\beta) + (F_{cgx}R_3\sin\beta)$$

and $$F_{BY} = \frac{(F_{cgy}R_{cg-c}\text{cosine }\beta) + (F_{cgx}R_{cg-c}\sin\beta) \quad I(-\alpha_3) - (F_{cgx}R_3\sin\beta)}{R_3 \text{ cosine } \beta} \quad 12^*$$

from Eq. C $$F_{cy} = F_{cy} - F_{by} \quad 13^*$$

Equations 11*, 12*, and 13* determine the magnitude of the X and Y reactions (remembering $F_{cx} = 0$ since it is assumed to be frictionless at the sliding joint in the *x*-direction) at pin joints B and C.

Figure 16:
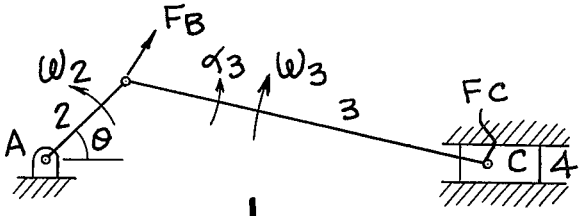

Referring now to FIG. 16, Link 2 is rigid and thus directly transfers the reaction at pin B ($F_B$) to pin A and consequently to Link 1 or the machine base. The reaction at pin C is caused by the sliding joint between Link 1 and Link 4 thus the base directly sustains the Y reaction at C or $F_c$. Imposed on the base or Link 1 are two reactions in the X–Y plane; reaction $F_B$ composed of $F_{BY}$ and $F_{BX}$, and reaction $F_c$ composed only of a Y-component. To dynamically balance the sifter mechanism in the X–Y plane, reactions $F_B$ and $F_c$ must be balanced.

Figure 17A:
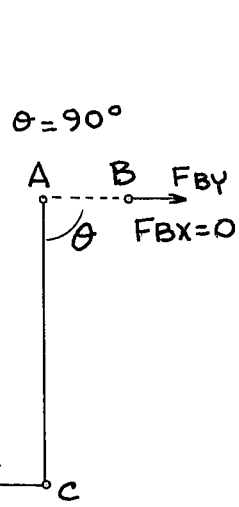
Figure 17B:
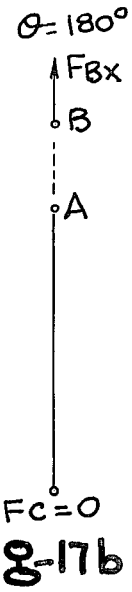

Referring to FIGS. 17 *a*, *b* and *c* to balance the slider crank mechanism in the X–Y plane with its mass concentrated along Link 3, the following equilibrium equations for the base must exist:

$$\Sigma F_x = 0$$

$$\Sigma F_y = 0$$

$$\Sigma M = 0$$

These equations require that $$F_{BWT} = F_{cgx\,\theta = 0^\circ}$$

$$F_{BY\theta = 90^\circ} - F_{cy\theta = 90^\circ} = F_{cgx\theta = 0^\circ}$$

$F_{BWT}$ must be positioned a certain distance $R_o$ from point A.

Point B on Link 3 must be a certain distance $R_3$ from point C.

Expressions for obtaining $R_3$ and $R_o$ will now be derived.

$$F_{cy} = F_{cgy} - \frac{(F_{cgy}R_{cg-c}\cos\beta) + (F_{cgx}R_{cg-c}c\sin\beta) + I(-\alpha_3) + F_{cgx}R_3\sin\beta)]}{R_3 \text{ cosine } \beta}$$

when $$\theta = 90^\circ,\ F_{cgx} = 0$$

since $\beta$ is small cosine $\beta \simeq 1$ $$\therefore F_{cy} = F_{cgy} - \frac{(F_{cgy}R_{cg-c}) + I\alpha_3}{R_3}$$

in $F_{by}$, $F_{cgy}$ and $I\alpha_3$ are both of the same sign and in Eq. a both are minus $$F_{cy} = \frac{F_{cgy}(R_3 - R_{cg-c}) - I\alpha_3}{R_3}$$

where $$\theta = 90^\circ$$

$$F_{By} - F_{cy} = \frac{-F_{cgy}R_{cg-c}}{R_3} - \frac{I\alpha_3}{R_3} - \frac{F_{cgy}(R_3 - R_{cg-c}) - I\alpha_3}{R_3}$$

$$= \frac{-F_{cgy}R_{cg-c}}{R_3} - \frac{I\alpha_3}{R_3} - \frac{F_{cgy}(R_3 - R_{cg-c})}{R_3} + \frac{I\alpha_3}{R_3}$$

$$F_{BY} - F_{cy} = \frac{F_{cgy}R_{cg-c}}{R_3} - \frac{F_{cgy}R_3}{R_3} - \frac{F_{cgy}R_{cg-c}}{R_3}$$

$$F_{by} - F_{cy} = -F_{cgy\theta=90^\circ} = F_{BWT} = -F_{cgx\theta = 0^\circ}$$

to be balanced: $F_{cgy\theta=90^\circ} = F_{cgx\theta=0^\circ}$ $$F_{cgx\theta=0^\circ} = \frac{WT}{Gc}[(R_2\omega_2^2 \text{ cosine } \theta) - (R_{B-cg}\alpha_3\sin\beta) + (R_{b-cg}\omega_3^2 \text{ cosine } \beta)]$$

B. $$F_{cgx\theta=0^\circ} = \frac{WT}{Gc}[(R_2\omega_2^2 \text{ cosine } \theta) + (R_{B-cg}\omega_3^2 \text{ cosine } \beta)]$$

$$F_{cgy\,\theta=90^\circ} = \frac{WT}{Gc}[(R_2\omega_2^2 \sin\theta) - (R_{B-cg}\alpha_3 \text{cosine } \beta) - (R_{b-cg}\omega_3^2 \sin\beta)]$$

C. $$F_{cgy\theta=90^\circ} = \frac{WT}{Gc}[(R_2\omega_2^2 \sin\theta) - (R_{B-cg}\alpha_3 \text{cosine } \beta)]$$

for $B = C$ it can be easily seen that $(R_{B-cg})\omega_3^2$ and $-R_{b-cg}\alpha_3$ must be equal or both terms must equal zero.

$R_{b-cg} = R_3 - R_{cg-c}$

Since $\omega_{3\theta=0^\circ}^2$ does not equal $\alpha_{3\theta=90^\circ}$ in most cases, the most logical way in which to make $F_{cgy\theta=90^\circ} = F_{cgx\theta=0^\circ}$ is to make $R_{B-cg} = 0$. $R_{B-cg}$ equals zero if $R_3 = R_{cg-c}$ -continued $\therefore R_3$ must equal $R_{cg-c}$ $$\frac{WT}{Gc}[(R_2\omega_2^2\text{cosine }\theta)+(R_{cg-c}-R_{cg-c})\,\omega_3^2\text{ cosine }\beta] =$$

$\theta=0°$ $$\frac{WT}{Gc}[(R_2\omega_2^2\sin\theta)+[(R_{cg-c}-R_{cg-c})\,\alpha_3\text{cosine }\beta)]$$

$\theta=90°$ $$\frac{WT}{Gc}(R_2\omega_2^2) = \frac{WT}{Gc}(R_2\omega_2^2),\ R_3=R_{cg-c}$$

when $\theta = 90°$ the reactions $F_B$ and $F_C$ on the base create a couple which tends to rotate the base. The balance weight therefore must balance the couple produced by $F_{BY}$, $F_{CY}$, and the distance $R_3$ separating the two forces. This can be accomplished by moving the balance weight a distance $R_o$ from point A on the base.

Referring to FIG. 18 and remembering $\Sigma M=0$, $\Sigma M_c = F_{BY}(R_3') - F_{BWT}(R_o)$ $$R_0 = \frac{F_{BY_{\theta=90°}}(R_3')}{F_{bwt}} - F_{BWT}(R_0)$$

To balance the slider crank mechanism representing the sifter mechanism in the X–Y plane, the following conditions must be met.

For the base, Link 1

$$\Sigma F_x = 0$$

$$\Sigma F_y = 0$$

$$\Sigma M = 0$$

$$F_{BWT} = -F_{cgx_{\theta=0°}} \qquad 14^*.$$

$$F_{BY_{\theta=90°}} - F_{cy_{\theta=90°}} = F_{CGX_{\theta=0°}} \qquad 15^*.$$

$$R_3 = R_{cg-c} \qquad 16^*.$$

$$R_0 = \frac{F_{BY\theta=90°}(R_3')}{F_{BWT}} \qquad 17^*.$$

An example of the application of this method follows:

$$\beta = \text{Arc sin}\frac{(R_2\sin\theta)}{R_3}$$

$$\omega_3 = \frac{R_2\omega_2\text{ cosine }\theta}{R_3\cos\beta}$$

$$\alpha_3 = \frac{(R_2\omega_2^2\sin\theta) - (R_3\omega_3^2\sin\beta)}{R_3\sin(90° - \beta)}$$

$$a_{cgx} = (-R_2\omega_2^2\cos\theta) + (R_{B-cg}\alpha_3\sin\beta) - (R_{B-cg}\omega_3^2\cos\beta)$$

$$a_{cgy} = (-R_2\omega_2^2\sin\theta) + (R_{B-cg}\alpha_3\cos\beta) + (R_{B-cg}\omega_3^2\sin\beta)$$

$$F_{cgx} = \frac{WT}{Gc}(-a_{cgx})$$

$$F_{cgy} = \frac{WT}{Gc}(-a_{cgy})$$

-continued $$F_{BX} = F_{cgx}$$

$$F_{by} = \frac{(F_{cgy}R_{cg-c}\text{ cosine }\beta) + (F_{cgx}R_{cg-c}\sin\beta) + I(-\alpha_3)}{R_3\text{ cosine }\beta} + \frac{(-F_{cgx}R_3\sin\beta)}{R_3\text{ cosine }\beta}$$

$$F_{cy} = F_{cgy} - F_{BY}$$

Note that all equations that describe the slider crank mechanism are dependent on sin $\theta$ and cosine $\theta$. All variables are basically sinusoidally which is illustrated by the following Chart 1:

| $\theta$ | $\beta$ | $\omega_3$ | $\alpha_3$ | $A_{cgx}$ | $A_{cgy}$ | $F_{cgx}$ | $F_{cgy}$ | $F_{bx}$ | $F_{by}$ | $F_{cy}$ |
|---|---|---|---|---|---|---|---|---|---|---|
| 0° | 0 | .571 | 0 | 355.3 | 0 | −798.0 | 0 | −798.0 | 0 | 0 |
| 30° | .868 | .495 | 5.381 | 307.7 | 177.7 | −691.1 | −399.1 | −691.1 | −1036.4 | 637.3 |
| 60° | 1.504 | .286 | 9.326 | 177.7 | 307.7 | −399.1 | −691.1 | −399.1 | −1795.8 | 1104.7 |
| 90° | 1.737 | 0 | 10.772 | 0 | 355.3 | 0 | −798.0 | 0 | −2074.2 | 1276.2 |
| 120° | 1.504 | −.286 | 9.326 | −177.7 | 307.7 | 399.1 | −691.1 | 399.1 | −1795.8 | 1104.7 |
| 150° | .868 | −.495 | 5.381 | −307.7 | 177.7 | 691.1 | −399.1 | 691.1 | −1036.4 | 637.3 |
| 180° | 0 | −.571 | 0 | −355.3 | 0 | 798.0 | 0 | 798.0 | 0 | 0 |
| 210° | −.868 | −.495 | −5.381 | −307.7 | −177.7 | 691.1 | 399.1 | 691.1 | 1036.4 | −637.3 |
| 240° | −1.504 | −.286 | −9.326 | −177.7 | −307.7 | 399.1 | 691.1 | 399.1 | 1795.8 | −1104.7 |
| 270° | −1.737 | 0 | −10.772 | 0 | −355.3 | 0 | 798.0 | 0 | 2074.2 | −1276.2 |
| 300° | −1.504 | .286 | −9.326 | 177.7 | −307.7 | −399.1 | 691.1 | −399.1 | 1795.8 | −1104.7 |
| 330° | −.868 | .495 | −5.381 | 307.7 | −177.7 | −691.1 | 399.1 | −691.1 | 1036.4 | −637.3 |
| 360° | 0 | .571 | 0 | 355.3 | 0 | −798.0 | 0 | −798.0 | 0 | 0 |

The following variables were used in determining the values calculated for Chart 1:

WT = 867 lbs.

I about axis perpendicular to the X–Y plane through point C on Link 4 = 3907.8 in-lb-sec$^2$ $R_3$ = 33 inches $R_{c\text{-}cg}$ = 0 inches (in other words point B on Link 3 coincides with the moving center of gravity.)

$R_2$ = 1 inch

Schematically, the slider crank mechanism now takes the form as shown in FIG. 19 with Joint B between Links 2 and 3 moved to coincide with the center of gravity of Link 3.

In order to balance the reactions $F_B$ and $F_C$ applied to the base, with an appropriate single balance weight, the base equilibrium equations ($\Sigma F_x$ 0, $\Sigma F_y = 0$, $\Sigma M = 0$) must all equal zero for all degrees of rotation $\theta$. Positioning of the links according to the present invention produces this result. Note that when $\theta = 0°$ or 180°, $F_{BX}$ = maximum value and $F_{cy} = 0$. Therefore the balance weight force must be equal to $F_{BX}$ maximum. However when $\theta$ 90° or 270°, $F_{BY}$ and $F_{cy}$ are at maximum values. The equilibrium equation $\Sigma F_y = 0$ for the base is true and since only one balance weight force is being used, $F_{BY} - F_{cy}$ must equal $F_{BWT}$ which equals $F_{BX}$ maximum. Another consideration is the couple formed by $F_{BY}$ and $F_{cy}$ as shown by FIGS. 20 (*a* through *c*). The tendency will be to rotate Link 1 or the base in a clockwise manner at that instant in time. Thus the positioning of the balance weight force along the base must be at a specific point in order to also balance the couple set up by $F_{BY}$ and $F_{cy}$.

Referring to FIGS. 20 (*a* through *c*) and to Chart 1, proper positioning of the balance weight force can be determined.

| When $\theta = 0°$ or 180° | When $\theta = 90°$ or 270° |
|---|---|
| $\Sigma F_x = F_{BWT} - F_{BX} = 0$ | $\Sigma F_x = 0$ |
| $F_{BWT} = F_{BX} = 798$ lb. | $\Sigma F_Y = -F_{BWT} + F_{BY} - F_{cy} = 0$ |
| $\Sigma F_Y = 0\ \theta = 0$ | $= -798 + 2074.2 - 1276.2$ |
| $\Sigma M = 0$ | $= 0$ |
| | $\Sigma M_c = 0 = -F_{BWT}(R_0 + R_3) + F_{by}(R_3')$ |
| | $= -798(R_0 + 33) +$ |

-continued $$R_0 + 33 = \frac{2074.2(33)}{798}$$

$$R_0 = \frac{2074.2(33)}{798} - 33 = 52.98 \text{ in.}$$

As a check when $\theta = 90°$ cosine $\beta \simeq 1$ $\Sigma M_A = 0 = -F_{BWT}(52.78) + F_{cy}(33) \quad \therefore R_3 \simeq R_3'$ $= -798(52.78) + 1276.2(33) = 0$ $\Sigma M_0 = 0 = F_{cy}(33 + 52.78) - F_{BY}(52.78)$ $1276.2(85.78) - 2074.2(52.78) = 0$ As a check when $\theta = 150°$ (refer to Figure 21)

$\Sigma F_x = 0 = F_{BX} - F_{BWTX} = 0$ $= 691.1 + (798 \text{ cosine } 150°) = 691.1 - 691.1 = 0$ $\Sigma F_y = 0 = F_{BY} - F_{cy} - F_{BWT}$ $= -1036.4 + 637.3 + 399.1 = 0$ $\Sigma M_c = 0 = F_{BY}(R_3') - F_{BWT}(R_3' + R_0)$ $= 1036.4(33) - 798(.5)(85.78) = 0$ Thus the hypothetical case is balanced. Reactions $F_B$ are considered at point A on the base, therefore $F_{BX}$ has no moment arm.

Figure 23:
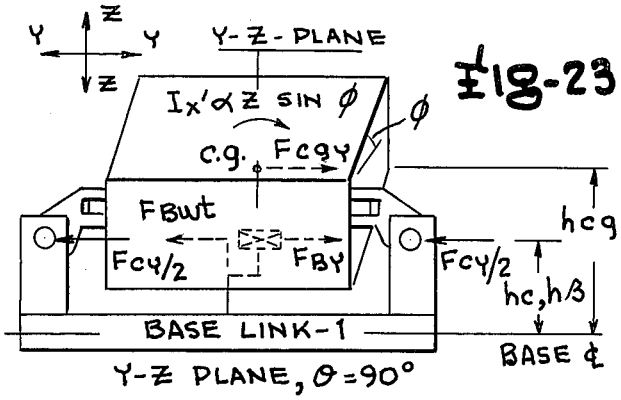

The previous discussion demonstrates dynamic balance of a slider crank mechanism in the X-Y plane only. Consideration is now directed to the X-Z and Y-Z planes as illustrated in FIGS. 22 and 23 wherein:

*hcg* = distance the moving mass center of gravity is above the base center line

*hb* = distance the bearing B centerline is above the base centerline

*hc* = distance linear bearing centerline is from base centerline

Note:

*hb* and *hc* are not necessarily the same

*hbwt* = distance $F_{BWT}$ is from the base centerline

It can readily be seen that both the X and Y components of $F_{cg}$ and $F_b$, displaced hcg and hb from the base center line, will produce a moment about the base. Also, proper positioning of $F_{BWT}$ and $F_{cy}$ above the base center line will balance the moments caused by $F_{cg}$ and $F_B$.

The moment component $I_x' \alpha_z \sin \phi$ requires a three dimensional analysis of rotation about a point at an angle $\phi$ relative to the coordinate axis passing through that point with $\phi$ representing the screen pitch.

Figure 24:
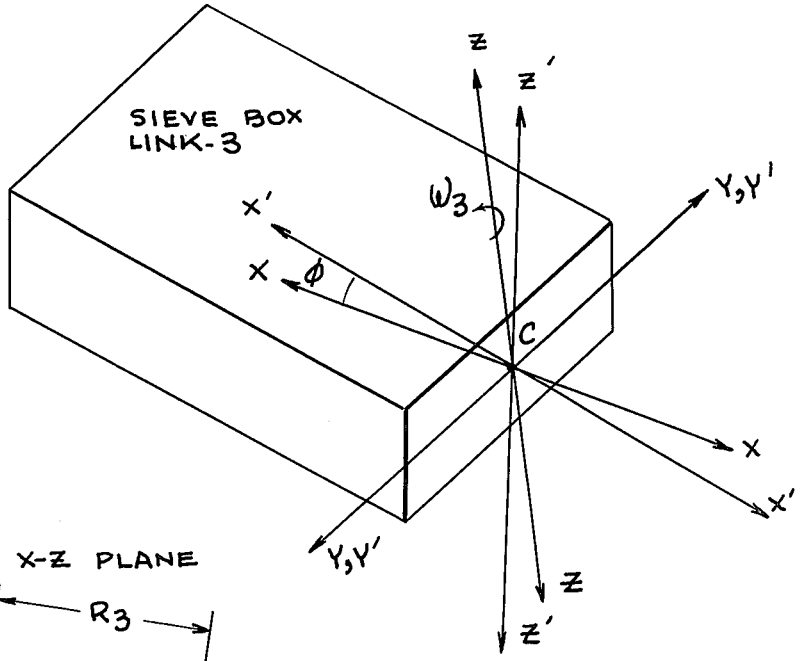

Referring to FIG. 24, when the screen is pitched at the angle $\phi$ the sieve box of Link 3, has, as its principal axes of inertia, the coordinate system X', Y', Z'. A transformation from the principal axes of inertia to the coordinate system, X, Y, Z of the base is necessary for determination of the base reactions. Utilizing Euler's Equations of Motion and taking the necessary sines and cosines of $\phi$ is a convenient manner to determine the base reactions.

The motion of a rigid body about a fixed point (the point can translate but cannot rotate which in this case is point C) can be described as follows:

$$\Sigma M_x' = I_x'\dot{\omega}_x' - (I_y' - I_z')\omega_y'\omega_z'$$

$$\Sigma M_y' = I_y'\dot{\omega}_y' - (I_z' - I_x')\omega_z'\omega_x'$$

$$\Sigma M_z' = I_z'\dot{\omega}_z' - (I_x' - I_y')\omega_x'\omega_y'$$

To simplify relations, X', Y', and Z' are chosen to coincide with the principal axes of inertia of Link 3, as shown in FIG. 24.

Note:

$$\omega_y' = 0$$

$$\Sigma M_x' = I_x'\dot{\omega}_x' - (I_y' - I_Z')\omega_y'\omega_z' = I_x'\omega_x' = I_x'\alpha_x'$$

$$\Sigma M_y' = I_y'\dot{\omega}_y - (I_z' - I_x')\omega_z'\omega_x' = -(I_z' - I_x')\omega_z'\omega_x'$$

$$\Sigma M_z' = I_z'\dot{\omega}_z' - (I_x' - I_y')\omega_x'\omega_y' = I_z'\omega_z' = I_z'\alpha_z'$$

$$\Sigma M_x' = I_x'\alpha_x'$$

$$\Sigma M_y' = -(I_z' - I_x')\omega_z'\omega_x'$$

$$\Sigma M_z' = I_z'\alpha_z'$$

Figure 25:
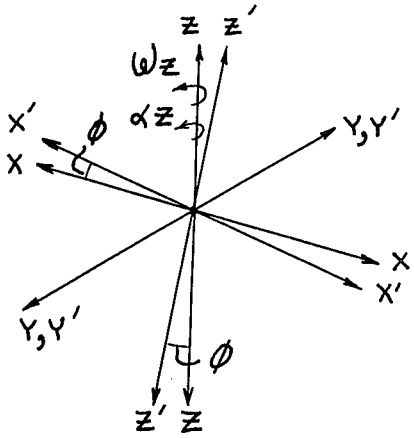

Referring to FIG. 25:

X', Y', Z' — Link 3 axes

X, Y, Z — base axes $$\omega_z' = \omega_z \text{ cosine } \phi$$

$$\omega_x' = \omega_z \sin \phi \qquad \omega_y' = \omega_y = 0$$

$$\alpha_z' = \alpha_z \text{ cosine } \phi$$

$$\alpha_x' = \alpha_z \sin \phi$$

$$\alpha_y' = \alpha_y = 0$$

$$\Sigma M_x = I_x' \alpha_z \sin \phi \qquad 18^*$$

$$\Sigma M_y = -(I_z' - I_x')\omega_z \text{ cosine } \phi\, \omega_z \sin \phi \qquad 19^*$$

$$\Sigma M_z = I_z' \alpha_z \text{ cosine } \phi \qquad 20^*$$

Equations 18*, 19*, 20* provide for any screen pitch $\phi$ of the screen surface. Combining equations 18*, 19*, and 20* with the previous equations for $F_b$, $F_c$, and $F_{cg}$, the moments about the base in all three planes can be determined enabling the balancing of the subject invention in all three planes by proper positioning of the balance weights and the linear bearing mounts.

Figure 26:
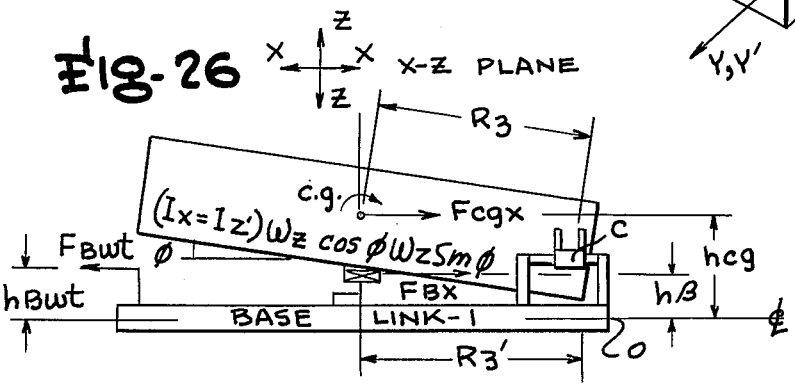

Referring to FIG. 26:

When $\theta = 0°$ or $180°$ $$\Sigma F_x = 0 = F_{BX} - F_{BWT} = 0$$

$$\Sigma F_z = 0$$

$$\Sigma M_o = \Sigma M_y = F_{cg_x}(\text{hcg}) + F_{B_x}(\text{hb}) - (I_x' - I_z')\omega_z^2 \text{ cosine } \phi \sin \phi - F_{BWT}(\text{hbwt})$$

$F_{BWT} = F_{cgx}$ from previous derivations

Therefore $$hbwt = \frac{F_{cg_x}(hcg) + F_{BX}(h_b) - (I_z' - I_x')\omega_z^2 \text{ cosine } \phi \sin \phi}{F_{BWT}} \qquad 21^*.$$

Note that when the screens are pitched at an angle $\phi$, $R_3'$ must be substituted in place of $R_3$ in calculating $F_{cg}$, $F_B$, and $F_c$. Note also, in calculating $F_{cg}$, $F_b$, and $F_c$, that $I_z'$ should be substituted in equation 12* for I.

Figure 27:
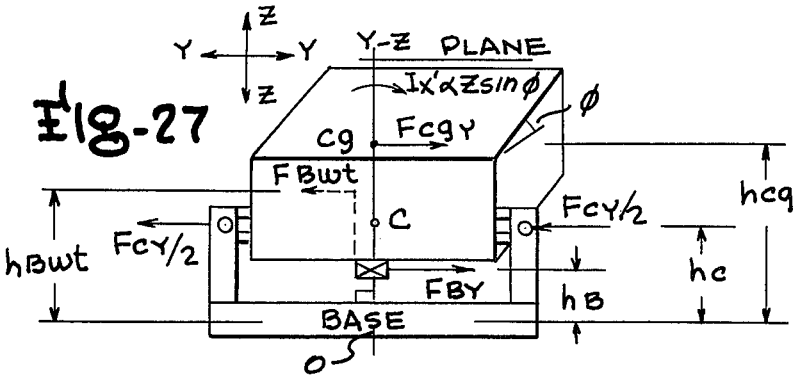

Referring to FIG. 27:

When $\theta = 90°$ $$\Sigma F_z = 0$$

$$\Sigma F_y = F_{cgy} + F_{BY} - F_{BWT} - F_{cy} = 0$$

$$\Sigma M_o = I_z' \alpha_z \sin \phi + F_{cgy}(\text{hcg}) + F_{BY}(\text{hb}) - F_{BWT}(\text{hbwt}) - F_{cy}(\text{hc})$$

From Equation 21*, hbwt is known knowing that $F_{Bx_{\theta=0°}} \neq F_{by_{\theta \neq 90°}}$ and $-(I_z' - I_x')\omega_z^2 \cos \phi \sin \phi\, F_{cgx_{\theta=0°}} hcg = F_{cgy_{\theta=90°}} hcg \neq$ $I_x' \alpha_z \sin \phi\, F_{cy_{\theta=90°}}(hc)$ must equal $-[F_{B_{x\theta=0°}}(hb) - 8I_z' - I_x')\omega_z^2 \text{ cosine } \phi \sin \phi] + [F_{BY_{\theta=90°}}(hb) + I_x' \alpha_z \sin \phi]$ Therefore $$hc = \frac{[F_{by_{\theta=90°}}(hb) + I_x' \alpha_z \sin \phi]}{F_{cy_{\theta=90°}}} \qquad 22^*.$$

-continued $$\frac{-[F_{bx\theta=0^\circ}(hb) - (I_z' - I_x')\,\omega_z^2 \text{ cosine } \phi \sin \phi}{F_{cy\theta=90^\circ}}$$

The mechanism according to the present invention, assuming it to be a rigid body, can thus be dynamically balanced in all three planes using only one balance weight force.

Dynamic balance of the sifter in all three planes is achieved when the following conditions are met.

$$F_{BWT} = -F_{cg_{x\theta=0^\circ}} = -F_{bx_{\theta=0^\circ}}$$

where $F_{cgx_{\theta=0^\circ}} = \frac{WT}{Gc}(R_2\omega_z^2)$, $$R_{B-cg} = 0 \; R_3 = R_{cg-c}$$

$$R_o = \frac{F_{By_{\theta=90^\circ}}(R_3')}{F_{BWT}}$$

Where $R_3' = R_3$ cosine $\phi$ $$F_{by_{\theta=90^\circ}} = \frac{(F_{cgy}R_{cg-c}\text{cosine } \beta) + I_z'\,\alpha_z \text{ cosine } \phi}{R_3' \text{ cosine}\beta}$$

$$F_{cgy} = \frac{WT}{Gc}(R_2\omega_2^2) \text{ and } R_{B-cg} = 0$$

$$hc = \frac{[F_{by_{\theta=90^\circ}}(hb) + I_x'\,\alpha_z \sin \phi]}{F_{cy_{\theta=90^\circ}}} - \frac{[F_{BX_{\theta=0^\circ}}(hb) - (I_z' - I_x')\,\omega_z^2 \text{ cosine } \phi \sin \phi]}{F_{cy_{\theta=90^\circ}}}$$

$$F_{cy} = F_{by_{\theta=90^\circ}} - F_{cgy_{\theta=90^\circ}}$$

$$hbwt = \frac{F_{cg_x\theta_{=0^\circ}}(hcg) + F_{bx_{\theta=0^\circ}}(hb) - (I_z' - I_x')\,\omega_z^2 \text{ cosine } \phi \sin \phi]}{F_{BWT}}$$

Figure 28:
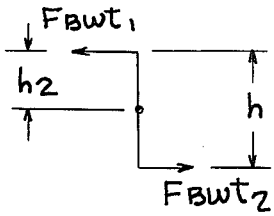

If *hbwt* proves to be too large, use two opposed balance weight forces (shown in FIG. 28) 180° separated by a vertical distance *h*.

Where $$F_{BWT_1} - F_{BWT_2} = F_{BWT},\; F_{BWT_2} = F_{BWT_1} - F_{BWT}$$

$$F_{BWT_1}\left(\frac{h}{2}\right) + F_{BWT_2}\left(\frac{h}{2}\right) = F_{BWT}(hbwt)$$

$$+ \left[F_{BWT_1}\left(\frac{h}{2}\right) - F_{BWT_2}\left(\frac{h}{2}\right) = F_{BWT}\left(\frac{h}{2}\right)\right]$$

$$F_{BWT_1}(h) = F_{BWT}(hbwt) + F_{BWT}\left(\frac{h}{2}\right)$$

$$F_{BWT_1}(h) = F_{BWT}\left(hbwt + \frac{h}{2}\right)$$

$$F_{BWT_1} = F_{BWT}\left(\frac{hbwt}{h} + \frac{1}{2}\right) \qquad 23^*.$$

$$F_{BWT_2} = F_{BWT_1} - F_{BWT} \qquad 24^*.$$

Figure 29:
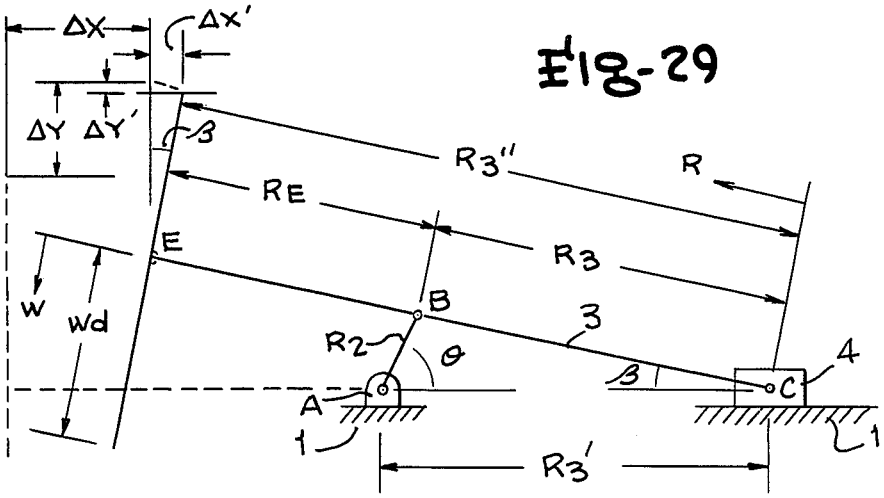

Referring to FIG. 29 *d*, schematic diagram of the sifter is shown which is represented by a slider crank mechanism having Link 3 extended beyond pin joint B by the distance $R_E$. The total length of Link 3 therefore is equal to $R_3 + R_E$. The distance $R_E$ represents the distance the eccentric of the sifter is moved from the inlet end towards the outlet end. Wd, derivations of velocities, accelerations, and reactions apply to the extended slider crank mechanism shown in FIG. 29.

Considering the screen surface motion in the X-Y plane, a screen aperture can be represented by a point any distance R along the length of the sieve box at a distance W from the sieve box center line. Referring to FIG. 29, all links are assumed to be rigid and the displacements in the X and Y direction for any degree of eccentric rotation, $\theta$, can be calculated for a given screen aperture. Thus the path that is traveled by any screen opening can be calculated and plotted.

The expressions for a point shown in FIG. 29, at the extreme inlet end of the sieve box at the maximum width of the box are:

$$\Delta X = R_2 \text{ cosine } \theta$$

$$\Delta X' = Wd \sin \beta$$

$$\Delta Y = R_3'' \sin \beta$$

$$-\Delta Y' = Wd\text{-}Wd \text{ cosine } \beta$$

$$\beta = \text{Arc sin } \frac{(R_2 \sin \theta)}{R_3}$$

For any arbitrary point $$\Delta X = R_2 \text{ cosine } \theta$$

$$\Delta X' = W \sin \beta$$

$$\Delta Y = R \sin \beta$$

$$-Y' = W\text{-}W \text{ cosine } \beta$$

**25*. Diplacement X = $R_2$ cosine $\theta$ + W sin $\beta$**

**26*. Displacement Y = R sin $\beta$ − (W-W cosine $\beta$)**

Figure 30:
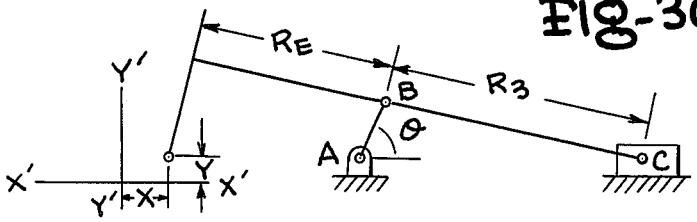

Referring to FIG. 30:

**25*. X = $R_2$ cosine $\beta$ + W sin $\beta$,**

$$\sin \beta = \sin\left[\text{Arc sin } \frac{(R_2 \sin \theta)}{R_3}\right]$$

$$Y = R \sin \beta - (W - W \text{ cosine } \beta) \sin \beta = \frac{R_2 \sin \theta}{R_3} \qquad 26^*.$$

For points lying on the sleeve box center line, W=0 then $$X = R_2 \text{ cosine } \theta$$

$$Y = R \sin \beta = R\left[\frac{R_2 \sin \theta}{R_3}\right]$$

It can readily be seen that the X displacement of any point on the sieve box center line is equal to the X displacement of pin joint B.

Note however that the Y displacement increases as R increases .

For $R < R_3$, $Y <$ Y pin joint B

For $R = R_3$, $Y =$ Y pin joint B

For $R > R_3$, $Y >$ Y pin joint B

It is advantageous to extend R beyond $R_3$ as far as is practical to increase the screen movement within the limits of dynamic balance, bearing loads, and the like.

It is generally thought that pure circular motion is the most efficient screening motion because it is believed that pure circular motion produces maximum screen movement. A comparison between pure circular motion and the motion of the sifter according to the present invention will now be made.

Figure 31:
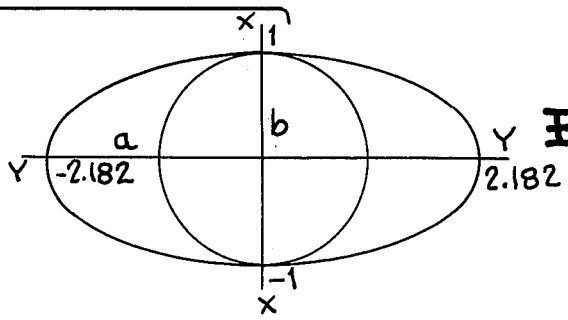

Referring now to FIG. 31, there is illustrated a comparison of sifter motion of a point in a sifter according to the present invention and a circular sifter wherein R = 72 inches, W=0, $R_2$ = 1 inch and $R_2$ = 33 inches.

FIG. 31 shows the difference in screen motion for a point located on the screen center line at the inlet end of the invention with an eccentric circle of 2 inches and that of a point located on the screen center line of a pure circular motion screener with the same 2 inch eccentric circle. The circumference of the circle of course equals $2\pi r$ which equals 6.28 inches while the circumference of the ellipse is approximated by $$\text{cir} \simeq 2\pi \left[ \frac{a^2 + b^2}{2} \right]$$

where $a \equiv \frac{1}{2}$ major axis $b = \frac{1}{2}$ minor axis $$\text{cir} = 2\pi \sqrt{\left[ \frac{(2.182)^2 + (1)^2}{2} \right]} = 10.66 \text{ in.}$$

An aperture at the inlet end of a sifter, according to the present invention, will travel 10.66/6.28 or 1.677 times farther than an aperture on the comparable circular sifter with an equal eccentric. A particle therefore has 1.6977 times more screen openings presented to it per revolution of the eccentric at the inlet end than with the circular screen.

As R decreases in equation 26*, Y decreases until the screen motion at the outlet end is simply linear motion at the screen surface center line. The distance an aperture travels on the centerline at the outlet end for one complete revolution of the eccentric equals 4 $R_2$ which equals 4 inches. An aperture at the outlet end of the comparable circular motion screener travels $2\pi r$ or 6.28 inches. It can be readily seen that where $R > R_3$ the screen motion is greater than that of the circular sifter. For that portion where $R < R_3$ the screen motion is less than that of a circular sifter.

All points on the screen surface of the circular motion screen travel identical circles equal to $2\pi r$ where $r$ is the eccentric radius. Thus the width of the screen surface in the case of the circular motion does not have an effect on the travel of any particular point. A study of the center line motion is therefore sufficient.

Referring to equations 25* and 26*, it can be readily seen that width, W, does have an effect on point motion of the herein described invention. If one calculates the various values of W it can be seen that increasing W increases total surface motion. Since $\beta$ is small, we will assume that the terms W sin $\beta$ and (W-W cosine $\beta$ are negligible. While this assumption introduces a slight error, it permits an analysis of the center line motion.

Figure 32A:
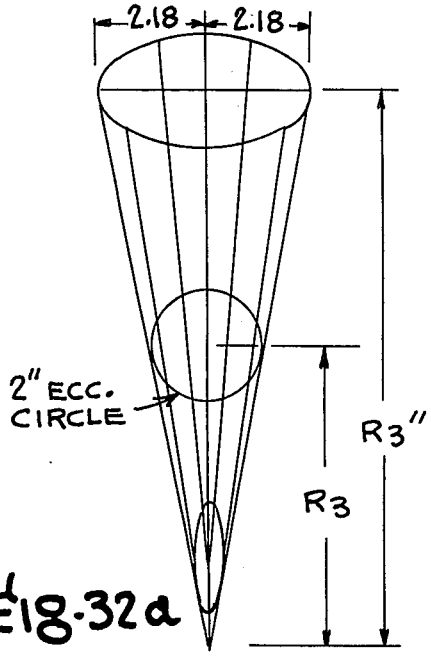
Figure 32B:
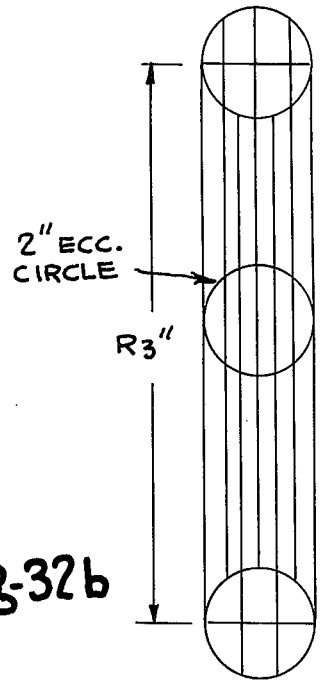

Referring now to FIG. 32*a* which shows the screen motion for the present invention and FIG. 33*b* which shows the screen motion for a circular motion sifter the following can be achieved: When $R_3 = 72$ inches, the projected area of the present invention center line motion $= 2.18\ R_3'' +$ area inlet end ellipse
$= (2.18 \times 72) + \frac{1}{2}(\pi 1 \times 2.18)$
$= 160.4$ square inches While the projected area of the circular motion screen center line $$= 2 \times R_3'' + \frac{\pi r^2}{2} = 145.6 \text{ in.}^2$$

$r \simeq$ eccentric radius = 1 inch

By proper positioning of the eccentric in the present invention a greater screen motion is achieved than in a comparable pure circular motion sifter. The present invention also produces greater screen motion than conventional gyratory-reciprocating type screeners or sifters. Although the total screen motion of the present invention is not excessively greater than that of the circular motion sifter, the inlet portion of the screen has much greater screen motion than the inlet portion of the circular sifter. The inlet portion of a screening device is where the majority of the undersize material passes through the screen. Therefore if one can improve the screen motion in this area there will be increased screening capacity and efficiency.

From the foregoing detailed description it will be evident that there are a number of changes, adaptations and modifications of the present invention which come within the province of those skilled in the art. However, it is intended that all such variations, not departing from the spirit of the invention, be considered as within the scope thereof as limited solely by the appended claims.

I claim:

1. A sifting and screening mechanism which is dynamically balanced in all three planes, said mechanism comprising a base, a screen assembly with an inclined sieve box having an inlet end, an outlet end and a screening surface, a linear bearing mounted on said base for supporting the outlet end of the sieve box to permit a reciprocating motion of the outlet end of the screen frame, eccentric drive means attached to the screen assembly beneath the center of gravity of the assembly for imparting a circular motion to the screen assembly at the center of gravity, a balancing shaft rotatably mounted on said base with the axis of rotation of said balancing shaft being generally parallel to the axis of rotation of said circular motion and spaced apart therefrom, means for maintaining the rate of rotation of the balancing shaft at the same rate of rotation as the eccentric drive means, a first balance weight fixedly attached to the balancing shaft at a predetermined location to provide counterbalancing of all of the forces and reactions created by the screen assembly motion thereby providing a sifting and screening mechanism of any screen slope which is completely balanced and produces increased screen motion at the inlet end to present more screen openings to particles traversing the length of the screen.

2. The sifting and screening mechanism of claim 1 additionally including a second balance weight positioned in opposed relation to said first balance weight on said balancing shaft and spaced apart a predetermined vertical distance from said first balance weight.

3. The sifting and screening mechanism of claim 2 additionally including a plurality of sieve boxes and a sieve frame on which the sieve boxes are stackable and a toggle assembly including a pressure bar positionable above an uppermost sieve box, and toggle means extending between the sieve frame and the pressure bar for pulling the pressure bar down against the uppermost sieve box to clamp the sieve boxes in position against said frame.

4. The sifting and screening mechanism of claim 3 wherein the screen assembly includes a plurality of sieve boxes having alignment pins on an upper edge thereof and openings on a lower edge thereof alignable with said pins on adjacent sieve boxes thereby permitting stacking of the sieve boxes with the pins and openings providing a desired alignment of the sieve boxes.

5. The sifting and screening mechanism of claim 2 wherein the screen assembly includes a plurality of sieve boxes having alignment pins on an upper edge thereof and openings on a lower edge thereof alignable with said pins on adjacent sieve boxes thereby permitting stacking of the sieve boxes with the pins and openings providing a desired alignment of the sieve boxes.

6. The sifting and screening mechanism of claim 2 wherein said eccentric drive means includes a drive shaft rotatably mounted on said base and having an eccentric shaft extending from one end thereof and rotatably engagable with said screen assembly, and a motor operatively connected to the drive shaft to rotate the drive shaft at the desired speed and wherein the means for maintaining the rate of rotation of the balancing shaft at the same rate of rotation as the drive shaft of the eccentric drive means includes a drive pulley on the drive shaft and a driven pulley on the balancing shaft with a non-slipping belt engagable with said pulleys.

7. The sifting and screening mechanism of claim 2 additionally including a resilient means between said outlet end and said base for preventing misalignment of said linear bearings.

8. The sifting and screening mechanism of claim 7 wherein the resilient means includes a tubular segment mounted in a vertical direction between said linear bearing and said screen assembly, a resilient body positioned inside said tubular segment, means for attaching a central portion of the upper end of the resilient body to the screen assembly and a motion limiting disk fixed to the screen assembly and having a downwardly directed outer lip which extends around the tubular segment and is spaced above and outside an upper lip of the tubular segment to permit limited movement of the screen assembly relative to the linear bearing to provide torsional freedom and prevent misalignment of the bearing.

9. The sifting and screening mechanism of claim 2 wherein the linear bearing includes a first and second bearing rod spaced apart in parallel alignment and mounted on said base, and a first and second bushing mounted on said screen assembly and slidably engagable with said first and second bearing rod to permit reciprocating motion between a portion of said screen assembly and said base.

10. The sifting and screening mechanism of claim 1 additionally including a resilient means between said outlet end and said base for preventing misalignment of said linear bearings.

11. The sifting and screening mechanism of claim 10 wherein the resilient means includes a tubular segment mounted in a vertical direction between said linear bearing and said screen assembly, a resilient body positioned inside said tubular segment means for attaching a central portion of the upper end of the resilient body to the screen assembly and a motion limiting disk fixed to the screen assembly and having a downwardly directed outer lip which extends around the tubular segment and is spaced above and outside an upper lip of the tubular segment to permit limited movement of the screen assembly relative to the linear bearing to provide torsional freedom and prevent misalignment of the bearing.

12. The sifting and screening mechanism of claim 1 additionally including a plurality of sieve boxes and a sieve frame on which the sieve boxes are stackable and a toggle assembly including a pressure bar positionable above an uppermost sieve box, and toggle means extending between the sieve frame and the pressure bar for pulling the pressure bar down against the uppermost sieve box to clamp the sieve boxes in position against said frame.

13. The sifting and screening mechanism of claim 1 wherein the screen assembly includes a plurality of sieve boxes having alignment pins on an upper edge thereof and openings on a lower edge thereof alignable with said pins on adjacent sieve boxes thereby permitting stacking of the sieve boxes with the pins and openings providing a desired alignment of the sieve boxes.

14. The sifting and screening mechanism of claim 1 wherein said eccentric drive means includes a drive shaft rotatably mounted on said base and having an eccentric shaft extending from one end thereof and rotatably engagable with said screen assembly, and a motor operatively connected to the drive shaft to rotate the drive shaft at the desired speed and wherein the means for maintaining the rate of rotation of the balancing shaft at the same rate of rotation as the drive shaft of the eccentric drive means includes a drive pulley on the drive shaft and a driven pulley on the balancing shaft with a non-slipping belt engagable with said pulleys.

15. The sifting and screening mechanism of claim 1 wherein the linear bearing includes a first and second bearing rod spaced apart in parallel alignment and mounted on said base, and a first and second bushing mounted on said screen assembly and slidably engagable with said first and second bearing rod to permit reciprocating motion between a portion of said screen assembly and said base.

16. A method for balancing a gyratory screener having a base, a sieve box, a linear bearing mounted on the base for supporting the sieve box at an outlet end of the sieve box, an eccentric drive means with an axis of rotation relative to the screen assembly and spaced apart from the linear bearing for causing a portion of the sieve box to move on a circular path, and a balancing shaft rotatably mountable on said base with the axis of rotation of said balancing shaft being generally parallel to the axis of rotation of said circular path, said method comprising positioning the axis of rotation of the circular path to pass through the center of gravity of the screen assembly, providing a means for rotating the balancing shaft and the eccentric drive means at the same rate of rotation, and selecting the weight of a first eccentric balance weight to be mounted on said shaft, the vertical position and eccentric position of said first weight and the distance of the axis of rotation of the balancing shaft from the axis of rotation of the circular path such that the gyratory screener is provided with dynamic balancing in all three planes.

17. The method of claim 16 additionally including positioning a second weight in opposed relation to said first eccentric balance weight on said balance shaft and selecting the weight of the second eccentric balance weight, the vertical position and eccentric position of said second weight relative to said first weight and the distance of the axis of rotation of the balance shaft from the axis of rotation of the circular shaft such that the gyratory screener will be dynamically balanced in all three planes.

* * * * *